US010181306B2

(12) United States Patent
Chang et al.

(10) Patent No.: US 10,181,306 B2
(45) Date of Patent: Jan. 15, 2019

(54) PEEP-PROOF DISPLAY APPARATUS AND DISPLAY METHOD THEREOF

(71) Applicant: AU Optronics Corporation, Hsin-Chu (TW)

(72) Inventors: Yiwen Chang, Hsin-Chu (TW); Super Liao, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/867,087

(22) Filed: Sep. 28, 2015

(65) Prior Publication Data

US 2017/0018254 A1 Jan. 19, 2017

(30) Foreign Application Priority Data

Jul. 15, 2015 (TW) ..... 104122927 A

(51) Int. Cl.

*G09G 5/02* (2006.01)
*G09G 3/20* (2006.01)
*G09G 3/34* (2006.01)

(52) U.S. Cl.

CPC ..... *G09G 5/02* (2013.01); *G09G 3/2022* (2013.01); *G09G 3/3406* (2013.01); *G09G 2320/068* (2013.01); *G09G 2320/0673* (2013.01); *G09G 2340/10* (2013.01); *G09G 2358/00* (2013.01)

(58) Field of Classification Search

CPC ..... G09G 5/10; G09G 5/02; G09G 2310/08; G09G 2320/0626; G09G 2320/0666; G09G 2320/0673; G09G 2320/068; G09G 2358/00

USPC ..... 345/691

See application file for complete search history.

(56) References Cited

U.S. PATENT DOCUMENTS

| | | | | |
|---|---|---|---|---|
| 7,762,676 | B2 | 7/2010 | Daly | |
| 8,836,715 | B2 | 9/2014 | Broughton et al. | |
| 2011/0317399 | A1* | 12/2011 | Hsu | G02F 1/1323 362/97.1 |
| 2012/0235891 | A1* | 9/2012 | Nishitani | G02B 3/0056 345/102 |
| 2016/0035292 | A1* | 2/2016 | Lee | G09G 3/3648 345/694 |

FOREIGN PATENT DOCUMENTS

| | | |
|---|---|---|
| TW | 201213988 | 4/2012 |

* cited by examiner

*Primary Examiner* — Nicholas Lee
*Assistant Examiner* — Ngan T Pham Lu
(74) *Attorney, Agent, or Firm* — McClure, Qualey & Rodack, LLP

(57) ABSTRACT

A peep proof display method adapted to a display apparatus including a first backlight module and a second backlight module. At a narrow view angle display mode, output a first data signal and a second data signal according to the first data signal. During a first sub-frame period, enable the first backlight module and disable the second backlight module so as to display the first data signal on the display apparatus. During a second sub-frame, enable the second backlight module and disable the first backlight module so as to display the second data signal on the display apparatus. A peak of a first light intensity distribution curve of the first backlight module is in a narrow viewing angle range. Peaks of a second light intensity distribution curve of the second backlight module are in a wide viewing angle range individual to the narrow viewing angle range.

20 Claims, 24 Drawing Sheets

PEEP-PROOF DISPLAY APPARATUS AND DISPLAY METHOD THEREOF

CROSS-REFERENCE TO RELATED APPLICATIONS

This non-provisional application claims priority under 35 U.S.C. § 119(a) on Patent Application No(s). 104122927 filed in Taiwan, R.O.C. on Jul. 15, 2015, the entire contents of which are hereby incorporated by reference.

TECHNICAL FIELD

The disclosure relates to a display method, more particularly to a peep-proof display apparatus and a display method thereof.

BACKGROUND

Recently, a variety of display products has popularly been applied to personal display apparatuses. Considering a user's privacy, peep-proof display apparatuses have become mainstream display products now.

Please refer to FIG. 1, which is a schematic view of a conventional peep-proof display apparatus 100. The display apparatus 100 includes a display panel 110, a peep-proof layer 130, and a backlight module 150. The peep-proof layer 130 is disposed between the backlight module 150 and the display panel 110 and is configured to change the distribution of light emitted by the backlight module, so as to provide peep-proof effect. The peep-proof layer 130 may be carried out by an assembly of a light control film, prism film and a diffuser or the like.

Another conventional peep-proof display apparatus employs a peep-proof film attached on the display panel 110 to change the light at a relative larger viewing angle in order to achieve peep-proof effect. However, a general peep-proof film has a certain optical structure that will limit or affect the light distribution after light passes through the film. Some light may leak to relative larger viewing angles. Then, the display quality and peep-proof effect will decrease, and the brightness provided by the display apparatus will decrease as well. Also, such optical films, such as the peep-proof film use expensive materials in their manufacture and lead to a thicker display module.

Accordingly, it is the goal to strive for in the art to provide good peep-proof effect without disposing any optical film and even unchanging the structure of a display apparatus.

SUMMARY

According to one or more embodiments, the disclosure provides a peep-proof display method, which is applied to a display apparatus comprising a display panel, a first backlight module and a second backlight module. In an embodiment, the peep-proof display method includes the following steps. Output a first data signal and output a second data signal according to the first data signal at a narrow viewing angle display mode. The first data signal has a first chromaticity value and a first brightness value, and the second data signal has a second chromaticity value and a second brightness value. Enable the first backlight module and disable the second backlight module during a first sub-frame period, so as to display the first data signal on the display panel. Enable the second backlight module and disable the first backlight module during a second sub-frame period, so as to display the second data signal on the display panel. The first backlight module has a first light intensity distribution curve having a peak in a narrow viewing angle range. The second backlight module has a second light intensity distribution curve having peaks in a wide viewing angle range. The wide viewing angle range does not overlap the narrow viewing angle range. The first sub-frame period does not overlap the second sub-frame period.

According to one or more embodiments, the disclosure provides a peep-proof display method, which is applied to a display apparatus comprising a display panel, a first backlight module and a second backlight module. In an embodiment, the peep-proof display method includes the following steps. Output a first data signal and output a second data signal according to the first data signal at a narrow viewing angle. The first data signal has a first gamma curve, and the second data signal has a second gamma curve. The second gamma curve is symmetrical to the first gamma curve. Enable the first backlight module and disable the second backlight module during a first sub-frame period, so as to display the first data signal on the display panel. Enable the second backlight module and disable the first backlight module during a second sub-frame period, so as to display the second data signal on the display panel. The first backlight module has a first light intensity distribution curve having a peak in a narrow viewing angle range. The second backlight module has a second light intensity distribution curve having peaks in a wide viewing angle range. The wide viewing angle range does not overlap the narrow viewing angle range, and the first sub-frame period does not overlap the second sub-frame period.

According to one or more embodiments, the disclosure provides a peep-proof display apparatus. In an embodiment, the peep-proof display apparatus includes a display panel, a time controller, a modulator, a first backlight module, and a second backlight module. The time controller is electrically connected to the display panel and configured to output a first data signal during a frame period comprising a plurality of sub-frame periods. The modulator is electrically connected to the time controller and configured to output a second data signal according to a selection signal and the first data signal. The first data signal has a first chromaticity value and a first brightness value, and the second data signal has a second chromaticity value and a second brightness value. The first backlight module is electrically connected to the display panel, and the second backlight module electrically connected to the display panel. The first backlight module has a first light intensity distribution curve having a peak in a narrow viewing angle range, and the second backlight module has a second light intensity distribution curve having peaks in a wide viewing angle range. The wide viewing angle range does not overlap the narrow viewing angle range. At a narrow viewing angle display mode, the display panel operates in response to the first data signal when the first backlight module is enabled and the second backlight module is disabled during a first sub-frame period; and operates in response to the second data signal when the second backlight module is enabled and the first backlight module is disabled during a second sub-frame period.

BRIEF DESCRIPTION OF THE DRAWINGS

The display invention will become more fully understood from the detailed description given hereinbelow and the accompanying drawings which are given by way of illustration only and thus are not limitative of the display invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

The term "first", "second" or the like in the disclosure is merely used to distinguish multiple elements or operations, which are named by the same technical term, from each other rather than to define a specific sequence or priority and even limit the scope of the disclosure.

Also, the term "couple", "coupled to", "connect", "connected to", "electrically connected to" or the like in the disclosure means the direct physical or electrical connection between multiple elements, the indirect physical or electrical connection between multiple elements, or the interaction between multiple elements.

Figure 1:
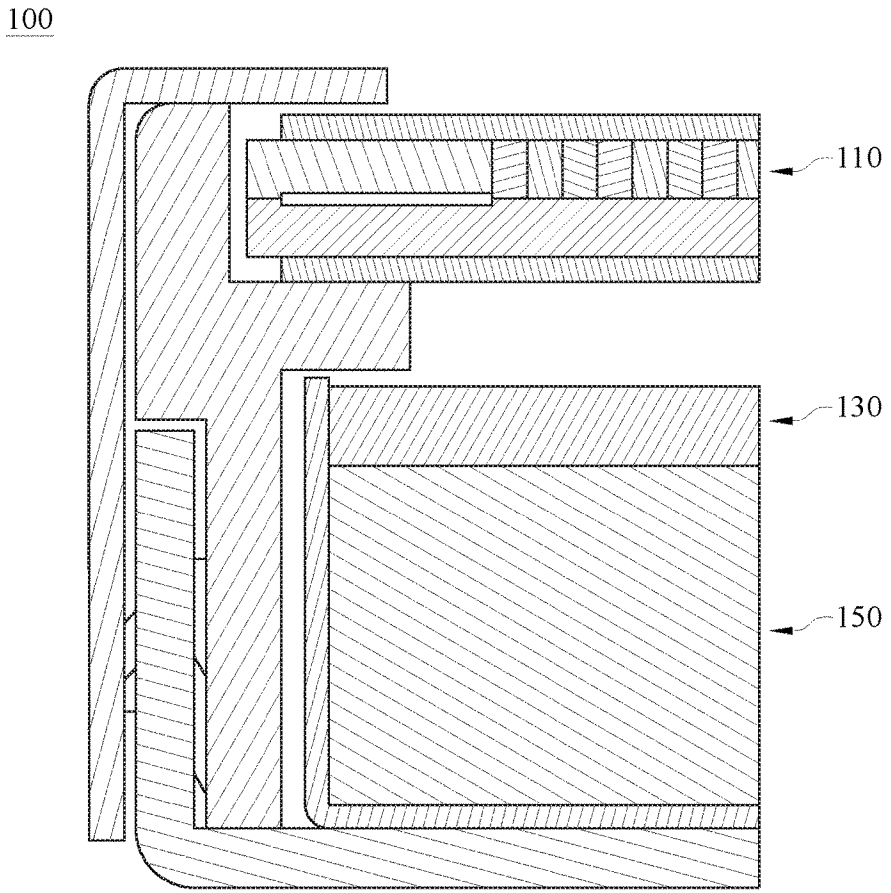
FIG. 1 (PRIOR ART)
FIG. 1 is a schematic view of a conventional peep-proof display apparatus.
Figure 2:
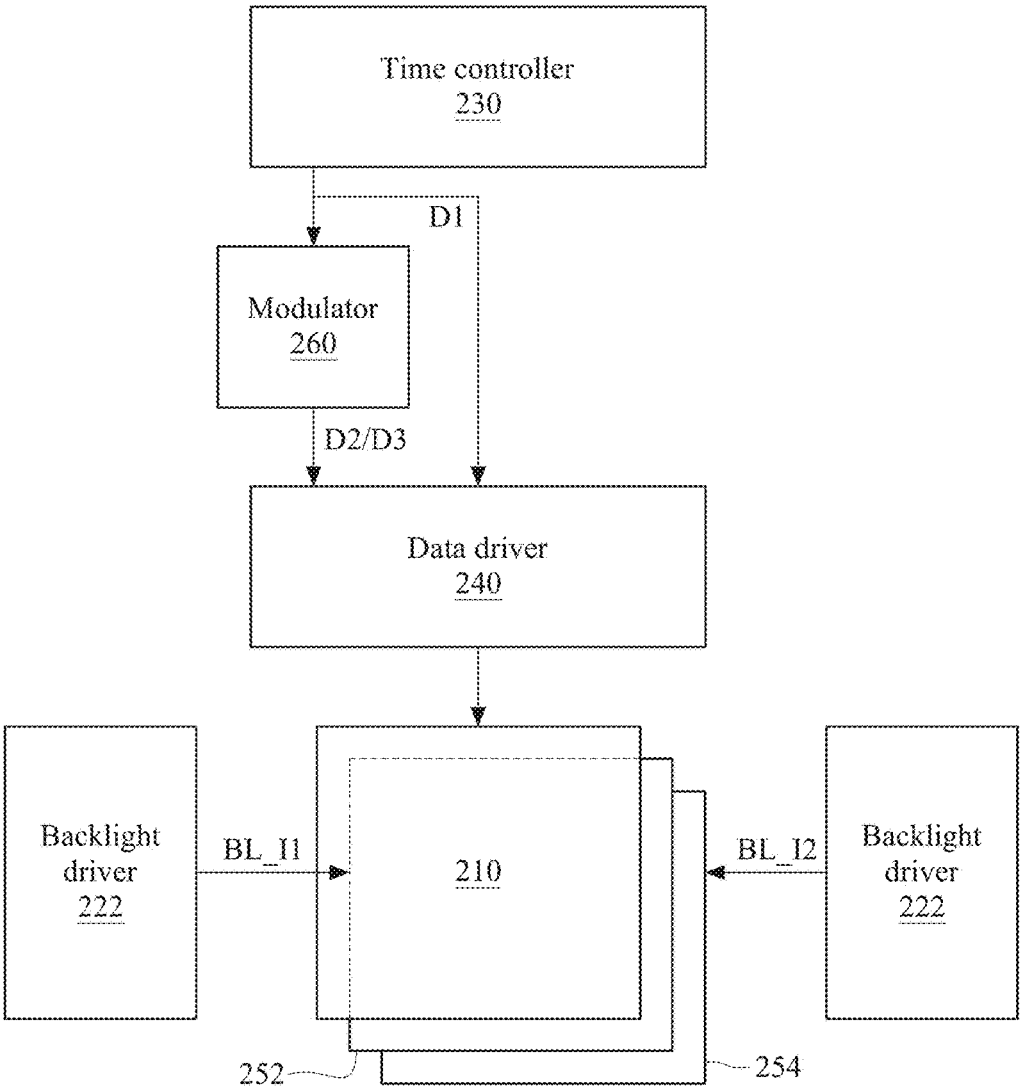
FIG. 2 is a schematic functional block diagram of a display apparatus according to an embodiment of the disclosure.

Please refer to FIG. 2, which is a schematic functional block diagram of a display apparatus 200 according to an embodiment of the disclosure. The peep-proof display apparatus 200 includes a display panel 210, a backlight module 252, a backlight module 254, a time controller 230, a modulator 260, a data driver 240, a backlight driver 222, and a backlight driver 224. The backlight driver 222 drives the backlight module 252 according to signals output by the time controller 230 so that the backlight module 252 emits light toward the display panel 210. The backlight driver 224 drives the backlight module 254 according to signals output by the time controller 230 so that the backlight module 254 emits light toward the display panel 210. The light emitted by the backlight module 254 first passes through either the backlight module 252 or an optical micro-structure so that the propagation path of the light will change.

The time controller 230 outputs a variety of data signals specifying image frames. A data signal has a chromaticity value and a brightness value. In an embodiment, the modulator 260 receives a data signal D1 and outputs a data signal D2 according to the data signal D1, and in another embodiment, the modulator 260 further outputs a data signal D3 according to the data signal D1 and the data signal D2. In an embodiment, the modulator 260 is integrated with the time controller 230 or is embodied on other driving chips or a printed circuit board, and the disclosure will not be limited thereto. The data driver 240 receives the data signals D1~D3 and then provides the data signals D1~D3 to the display panel 210 so that the display panel 210 can display image frames corresponding to the data signals D1~D3. In an embodiment, the data driver 240 is integrated into the time controller 230 or the modulator 260, and the disclosure will not be limited thereto.

Figure 3A:
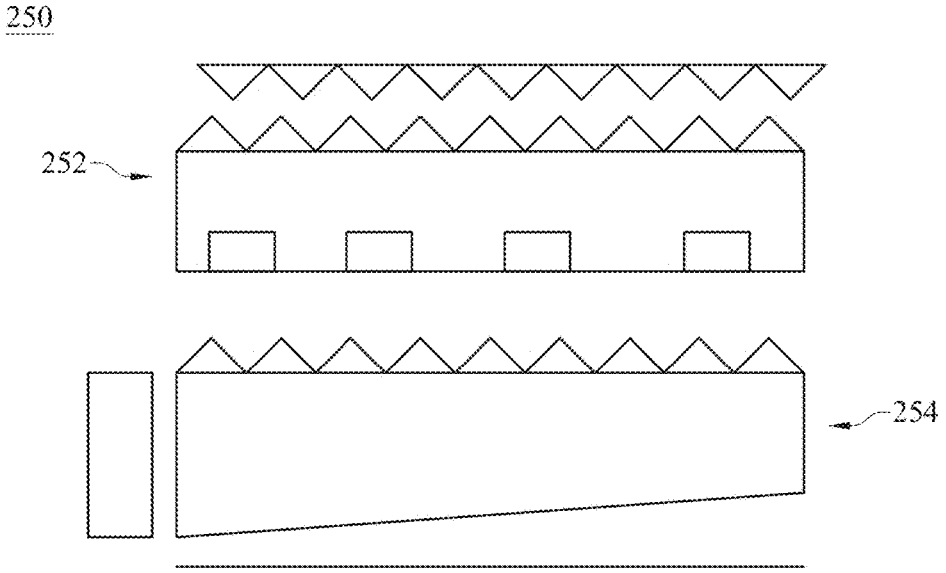
FIG. 3A is a schematic view of a backlight module in the display apparatus in FIG. 2 according to an embodiment of the disclosure.

FIG. 3A is a schematic view of a backlight module 250 in the display apparatus in FIG. 2 according to an embodiment of the disclosure. The backlight module 250 includes a backlight module 252 and a backlight module 254 overlapping the backlight module 252 so that the light emitted by the backlight module 254 first passes through the backlight module 252 or an optical micro-structure and then its propagation direction changes. In an embodiment, the backlight module 252 is a direct back-lit backlight module that emits light having a narrow viewing angle range, and the backlight module 254 is an edge back-lit backlight module. The light propagating from the backlight module 254 has a wide viewing angle range after passing through the backlight module 252. The position of the backlight module 254 and the position of the backlight module 252 can change according to an actual design of optical viewing angle.

Figure 3B:
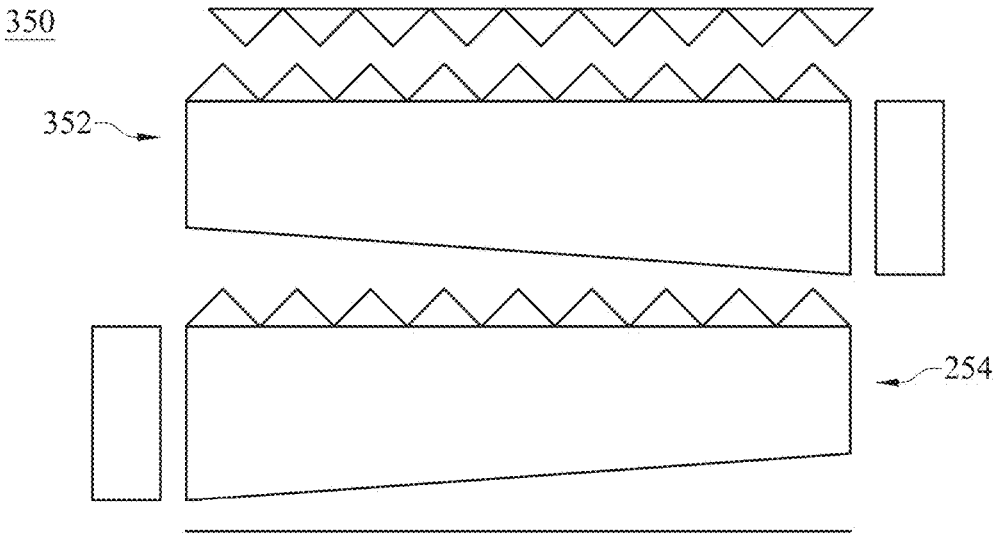
FIG. 3B is a schematic view of a backlight module in the display apparatus in FIG. 2 according to another embodiment of the disclosure.

FIG. 3B is a schematic view of a backlight module 350 in the display apparatus in FIG. 2 according to another embodiment of the disclosure. The backlight module 350 includes a backlight module 352 and a backlight module 254 overlapping the backlight module 352. In an embodiment, the backlight module 352 and the backlight module 254 are edge back-lit backlight modules, and the disclosure will not be limited thereto. In practice, the backlight module 250 or 350 can be designed in various ways in order to emit light having a narrow viewing angle range as well as light having a wide viewing angle range.

Figure 4A:
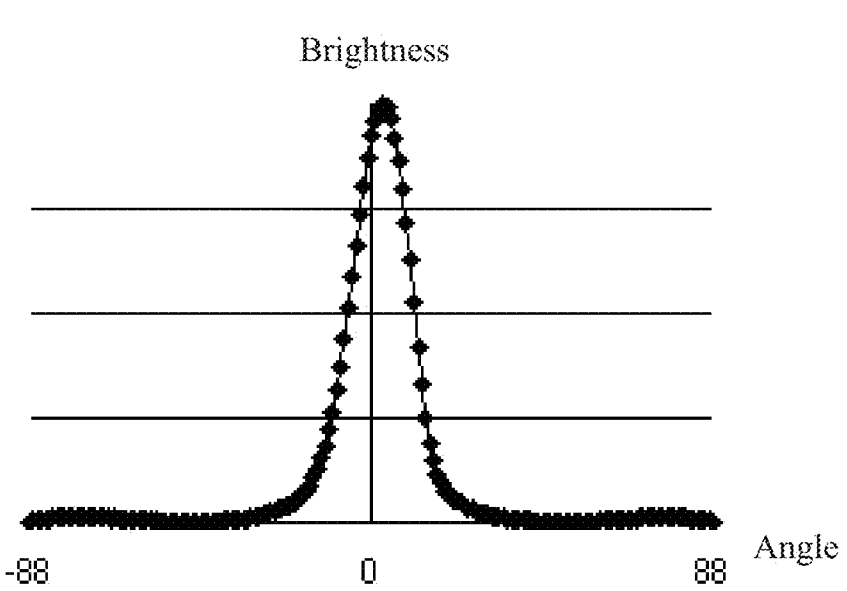
FIG. 4A is a light distribution map of a backlight module with a narrow viewing angle range according to an embodiment of the disclosure.
Figure 4A:
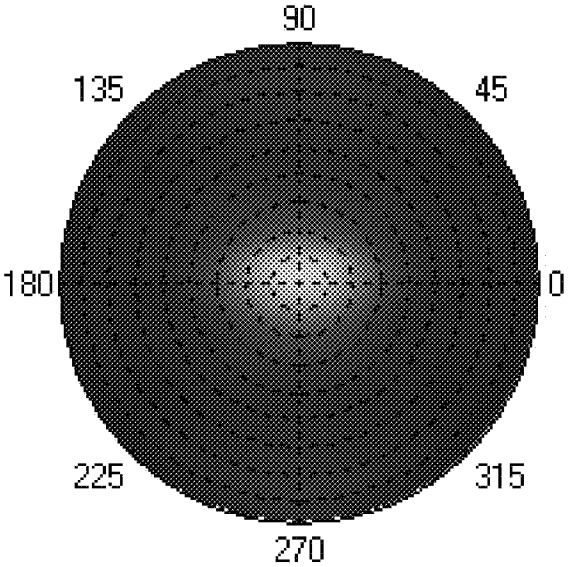
Figure 4B:
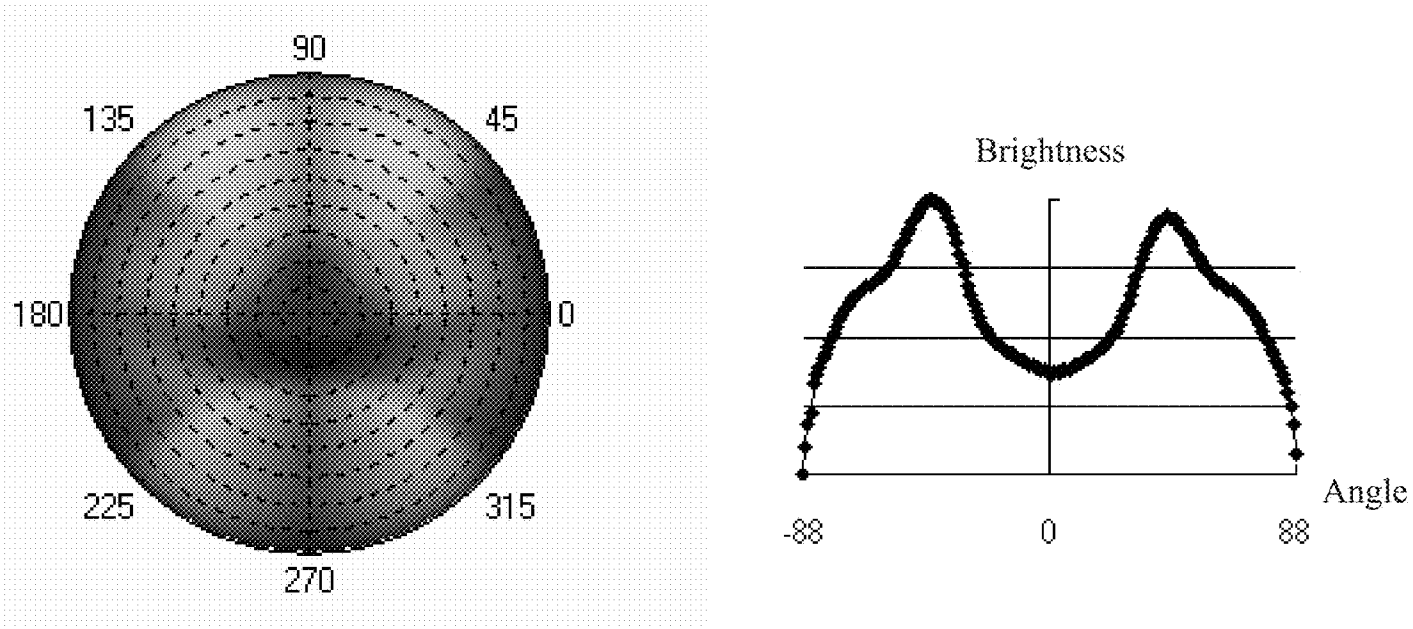
FIG. 4B is a light distribution map of a backlight module with a wide viewing angle range according to an embodiment of the disclosure.

Please refer to FIG. 4A and FIG. 4B, which are light distribution maps of a backlight module with a narrow viewing angle range and a backlight module with a wide viewing angle range, respectively. In the drawings, the horizontal axis redisplays viewing angles, and the vertical axis redisplays light intensities.

As shown in FIG. 4A, the light distribution curve in the narrow viewing angle range is a bell-shaped curve or a Gaussian distribution curve, and there is only one peak in the narrow viewing angle range. The majority of light propagates in the narrow viewing angle range, and none or a minority of light, propagating from the backlight module in the narrow viewing angle range, propagates in two side viewing angle ranges (i.e. the wide viewing angle range).

As shown in FIG. 4B, the light distribution curve has a peak at each of two sides of the wide viewing angle range, that is, a viewer can receive a majority of light when viewing the display apparatus by a larger viewing angle in the wide viewing angle range (i.e. side-viewing), but can only receive a minority or none of light when viewing the display apparatus by a smaller viewing angle in the narrow viewing angle range (i.e. substantially vertical-viewing). The so-called narrow viewing angle range herein means smaller viewing angles each is substantially between 0 degree (which redisplays the normal line of the display panel 210) and ±20 degrees, and the narrow viewing angle range can be designed according to actual usage requirements of vertically viewing display apparatuses of general mobile devices or the like. The so-called wide viewing angle range herein means larger viewing angles each is substantially larger than +20 degrees or smaller than −20 degrees, that is, the wide viewing angle range is the default viewing angle range of a display apparatus minus the narrow viewing angle range. In practice, the narrow and wide viewing angle ranges can be designed according to implementation requirements, such as user's experiences and environment conditions. Although the disclosure merely defines that a certain viewing angle range, which light propagates to, is the aforementioned narrow viewing angle range and that viewing angle range at two outer sides of the narrow viewing angle range.

When operating at the wide viewing angle display mode, the display apparatus can enable the backlight module 252 and the backlight module 254 simultaneously or alternately and display image frame specified by the data signal D1. The backlight module 252 mainly provides light of the narrow viewing angle range, and the backlight module 254 mainly provides light of the wide viewing angle range. Therefore, the light distribution of the mixed light produced by the backlight module 252 and the backlight module 254 has a light intensity that allows viewers to receive the mixed light and then see the same image frame no matter if the viewers look the display apparatus in the wide viewing angle range or the narrow viewing angle range.

In an embodiment, the viewing angle range at the wide viewing angle display mode can increase. In an embodiment, since both the backlight modules emit light at the wide viewing angle display mode, the image frame still has a sufficient enough brightness value under lower currents to drive the two backlight modules, so as to lower power consumption as well as achieve good peep-proof effect.

When operating at the narrow viewing angle display mode, the display apparatus can enable the backlight module 252 and the backlight module 254 alternately. When the backlight module 252 is enabled, the display panel 210 displays image frames specified by the data signal D1. When the backlight module 254 is enabled, the display panel 210 displays image frames specified by the data signal D2. The data signal D1 is different from the data signal D2. Therefore, the viewer in the narrow viewing angle range can receive light from the backlight module 252. Although the backlight module 252 mainly provides light toward the narrow viewing angle range, a minority of the light propagating toward the narrow viewing angle range may leak toward the wide viewing angle range. Therefore, enabling the backlight module 254 and displaying the data signal D2 can compensate the image frames conveyed by the leak in the wide viewing angle range, thereby achieving good peep-proof effect.

In an embodiment, the light intensity provided by the backlight module 254 is weaker than the light intensity provided by the backlight module 252. In an embodiment, the light intensity of light provided by the backlight module 252 and propagating in the wide viewing angle range is substantially equivalent to the light intensity of light provided by the backlight module 254 and propagating in the wide viewing angle range, in order to achieve good peep-proof effect.

In an embodiment, as shown in FIG. 2, the time controller 230 outputs the data signal D1 conveying an image frame, and the data signal D1 has a chromaticity value C1 and a brightness value B1. The modulator 260 outputs the data signal D2 according to the data signal D1 and may output the data signal D3 according to both the data signal D1 and the data signal D2 after receiving the data signal D1. The data signal D2 has a chromaticity value C2 and a brightness value B2. The data signal D3 has a chromaticity value C3 and a brightness value B3. In an example, the chromaticity value C2 is based on the chromaticity value C1, and the brightness value B3 is based on both the brightness value B2 and the brightness value B1. In an example, the brightness value B2 is based on the brightness value B1, and the chromaticity value C3 is based on both the chromaticity value C2 and the chromaticity value C1.

In another embodiment, the time controller 230 outputs the data signal D1 conveying an image frame, and the data signal D1 has a gamma curve G1. The modulator 260 outputs the data signal D2 according to the data signal D1 and may output the data signal D3 according to both the data signal D1 and the data signal D2 after receiving the data signal D1. The data signal D2 has a gamma curve G2 that is related to the gamma curve G1. In an example, the gamma curve G2 is an inverse of the gamma curve G1 or is symmetrical to the gamma curve G1.

Figure 13:
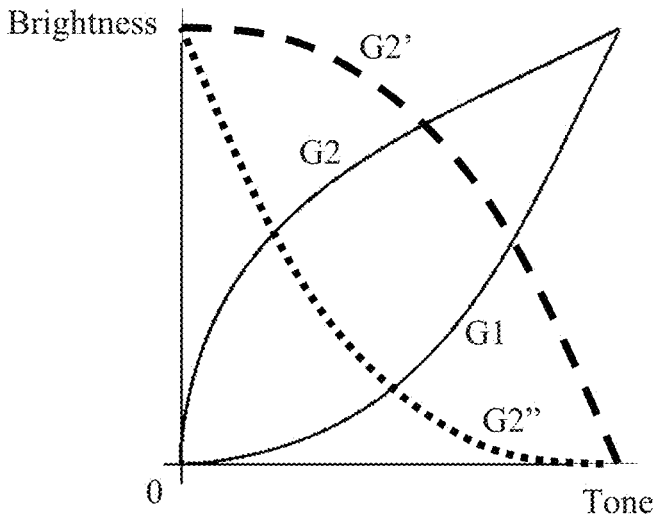
FIG. 13 is a schematic diagram of a gamma curve of a data signal according to an embodiment of the disclosure.

Please refer to FIG. 13, which is a schematic diagram of a gamma curve of a data signal according to an embodiment of the disclosure. The x axis redisplays tones of 0 to 255, which a gray value of a gray signal. The y axis redisplays the brightness value of brightness sensed by human eyes, such as a normalized brightness value 0 or 1. In an exemplary embodiment, the gamma curve G1 redisplays the data signal D1, and the gamma curve G2 redisplays the data signal D2. When the gray value of the data signal D1 is 32, the brightness value herein is 0.1. The gamma curve G2 is substantially symmetrical to the gamma curve G1 along a 45-degree angle so the gamma curve G2 herein is considered as an inverse of the gamma curve G1, that is, is complementary to the gamma curve G1. The data signal D3 has a gamma curve G3, which is related to a combination of the gamma curve G1 and the gamma curve G2. In an example, the gamma curve G3 is an inverse of the combination of the gamma curve G1 and the gamma curve G2.

Figure 5A:
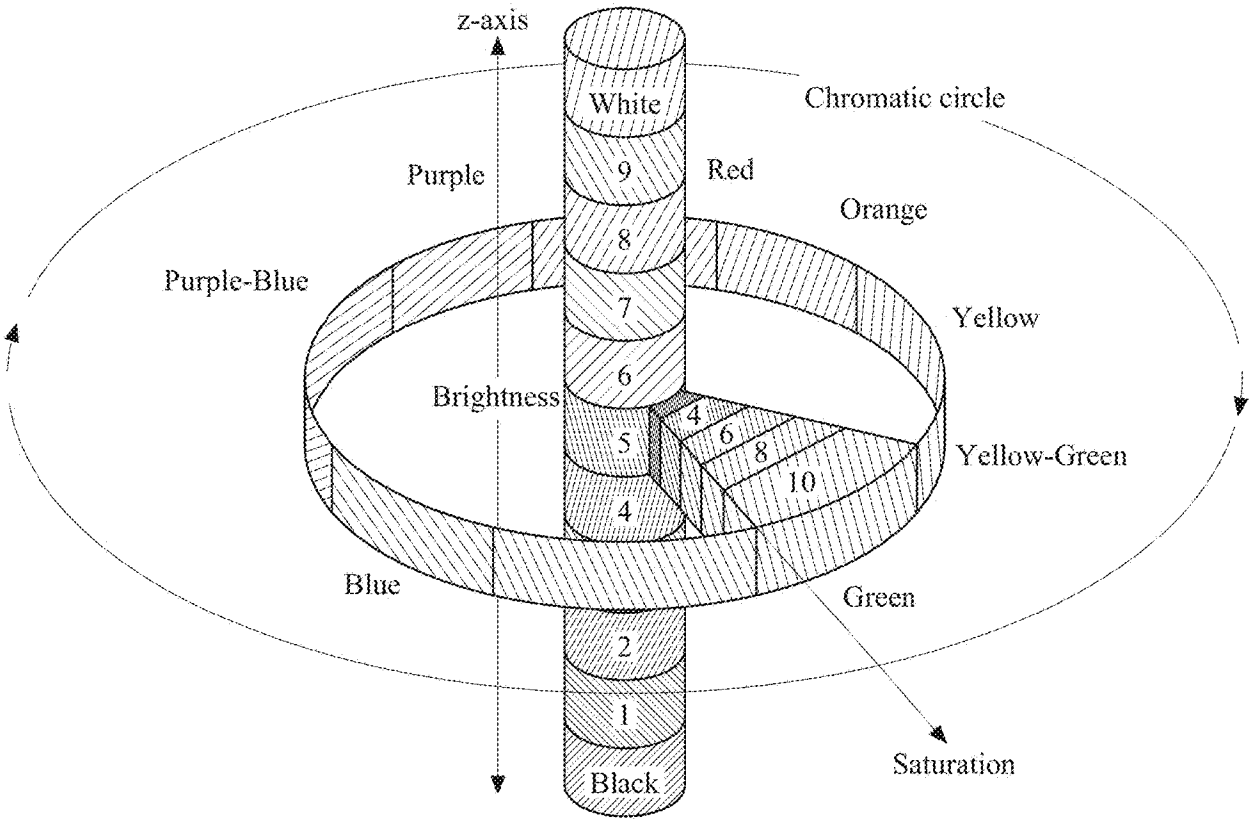
FIG. 5A is a schematic diagram of a color space based on the Munsell color apparatus.
Figure 5B:
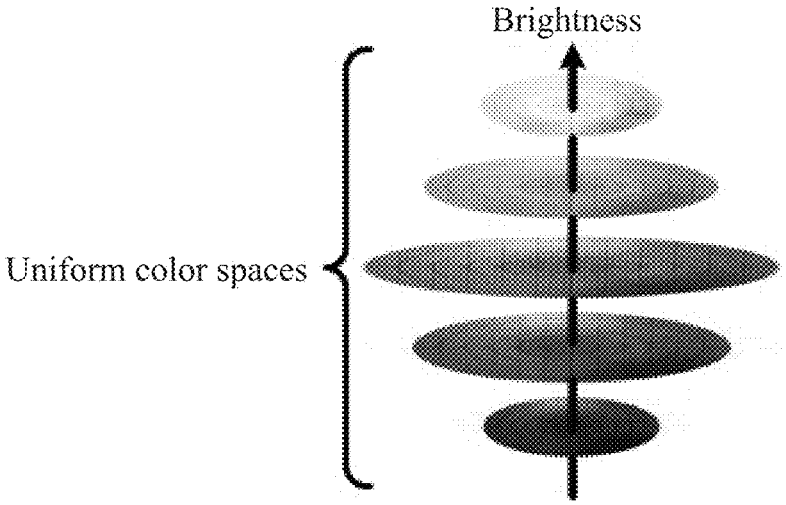
FIG. 5B is a schematic diagram of a uniform color space based on the Munsell color apparatus.

Please refer to FIG. 5A and FIG. 5B, which are respectively a schematic diagram of a color space and a schematic diagram of a uniform color space based on the Munsell color apparatus. Munsell color apparatus is a graphic sphere having a color space and a brightness axis. Each position in the color space redisplays a different color and a different saturation. A color is formed by mixing three primary colors in a certain ratio. As shown in FIG. 5A, different colors formed by mixing three primary color by different ratios can form multiple chromatic circles. In the same color space, each point on a chromatic circle of a different radius indicates a different color formed by mixing three primary colors by the same ratio under a different saturation. A different saturation value redisplays a different shade of the same color and is drawn by a different radius from a chromatic circle to the center of the chromatic circle in the same color space. Both the brightness axis and the saturation value affect the shade of the same color. In an example, a color point indicating a greater brightness value and a greater saturation value is located at a higher position in an upper half part of the sphere; otherwise, a color point indicating a smaller brightness value and a smaller saturation value is located at a lower position in a lower half part of the sphere.

As shown in FIG. 5B, multiple uniform color spaces respectively correspond to different locations on the brightness axis, and these uniform color spaces have the same chromaticity value but correspond to different brightness axes, respectively. For example, the chromaticity value C1 has a twin chromaticity value C1' in any uniform color space, and the chromaticity value C1' has the same hue but a different saturation and brightness value as compared to the chromaticity value C1. There is a chromaticity value C2 symmetrical to the center in the same uniform color space where the chromaticity value C1 exists, so the chromaticity value C2 is complementary to the chromaticity value C1 in hue and has the same saturation and brightness with the chromaticity value C1. The color point redisplaying a mixture of the chromaticity value C2 and the chromaticity value C1 is the center of the color space.

The higher the brightness value of the uniform color space, the brighter the uniform color space. The lower the brightness value of the uniform color space, the darker the uniform color space. For example, when the brightness value B1 corresponds to a brightness value B2 symmetrical to an origin of z-axis (i.e. a brightness axis), the brightness value B2 is complementary to the brightness value B1. Herein, the so-called grey scale redisplays a different location along the brightness axis at the center of the uniform color space and has a brightness variation range from black to white.

Figure 6A:
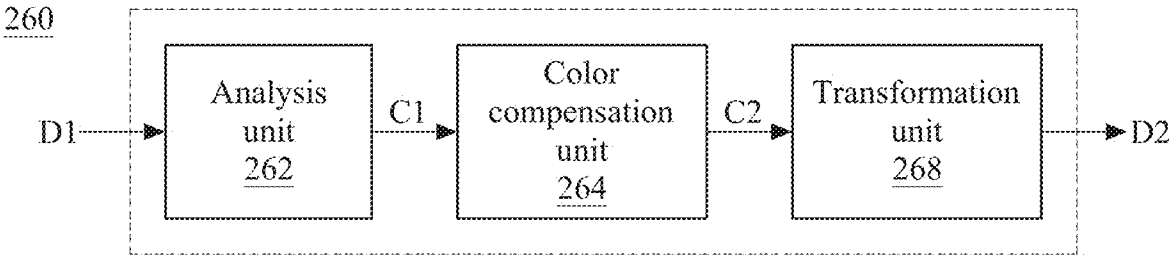
FIG. 6A is a schematic functional block diagram of a modulator in the display apparatus according to an embodiment of the disclosure.

Please refer to FIG. 6A, which is a schematic functional block diagram of a modulator in the display apparatus according to an embodiment of the disclosure. At the narrow viewing angle display mode, the display panel 210 receives and displays the data signal D1 and the data signal D2. The data signal D2 is produced according to the data signal D1. The modulator 260 receives the data signal D1 and employs an analysis unit 262 to analyze the content of the data signal D1 and then obtain the chromaticity value C1. A color compensation unit 264 calculates a complementary chromaticity value C2 according to the chromaticity value C1. The chromaticity value C1 and the chromaticity value C2 are symmetrical to each other along the center of the same color space. A transformation unit 268 produces the data signal D2 according to the chromaticity value C2. When the backlight module 254 emits light toward the wide viewing angle range, the display panel 210 can display the data signal D2. Therefore, the data signal D2 can be used to compensate the light corresponding to the data signal D1 and emitted by the backlight module 252 toward the wide viewing angle range. Such means of complementing chromaticity may cause that side viewers cannot sense the colors of image at a side viewing angle at the narrow viewing angle display mode in order to achieve good peep-proof effect. Also, the viewer at the narrow viewing angle still can see the clear and correct information on display in the narrow viewing angle.

In another embodiment, analyzing the content of the data signal D1 can obtain a brightness value B1. A brightness complementation operation is performed to the brightness value B1 and obtains a complementary brightness value B2. The brightness value B1 and the brightness value B2 are symmetrical to each other about the origin of the brightness axis. The brightness value B2 is transformed into the data signal D2. When the backlight module 254 emits light toward the wide viewing angle range, the display panel 210 then displays the data signal D2. Therefore, the data signal D2 can be used to compensate the light emitted by the backlight module 252 toward the wide viewing angle range and corresponding to the data signal D1. Such means of complementing brightness value may cause that side viewers cannot sense the colors of image at a side viewing angle at the narrow viewing angle display mode in order to achieve good peep-proof effect. Also, the viewer at the narrow viewing angle still can see the clear and correct information on display in the narrow viewing angle.

Figure 6B:
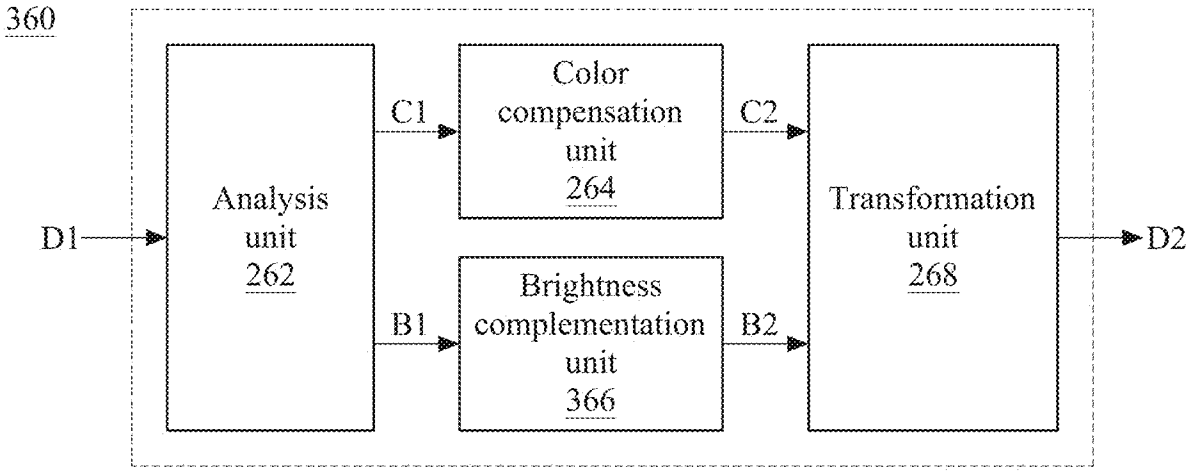
FIG. 6B is a schematic functional block diagram of a modulator in the display apparatus according to another embodiment of the disclosure.

Please refer to FIG. 6B, which is a schematic functional block diagram of a modulator 360 in the display apparatus according to another embodiment of the disclosure. The modulator 360 substantially performs the same operations as the modulator 260, and they will not be repeated hereinafter. Notice that the modulator 360 can simultaneously perform the color compensation operation and the brightness complementation operation. The analysis unit 262 analyzes the content of the data signal D1 and obtains a chromaticity value C1 and a brightness value B1. The color compensation unit 264 generates a complementary chromaticity value C2 according to the chromaticity value C1. The chromaticity values C1 and C2 are complementary color values and are symmetrical to each other about the center of the same color space. The brightness complementation unit 366 generates a brightness value B2 according to the brightness value B1, and the brightness values B1 and B2 are symmetrical to each other about the origin of the same brightness axis. The transformation unit 268 transforms the chromaticity value C2 and the brightness value B2 into a data signal D2.

The complementation of chromaticity and brightness, as mentioned above, prevents side viewers from sensing the chromaticity and brightness of images at a side viewing angle at the narrow viewing angle display mode in order to achieve good peep-proof effect. As compared to the modulator 260 only compensating either the chromaticity or the brightness, the display device employing the modulator 360 may provide better peep-proof effect. Also, the viewer at the narrow viewing angle still can see the clear and correct information on display in the narrow viewing angle.

Figure 6C:
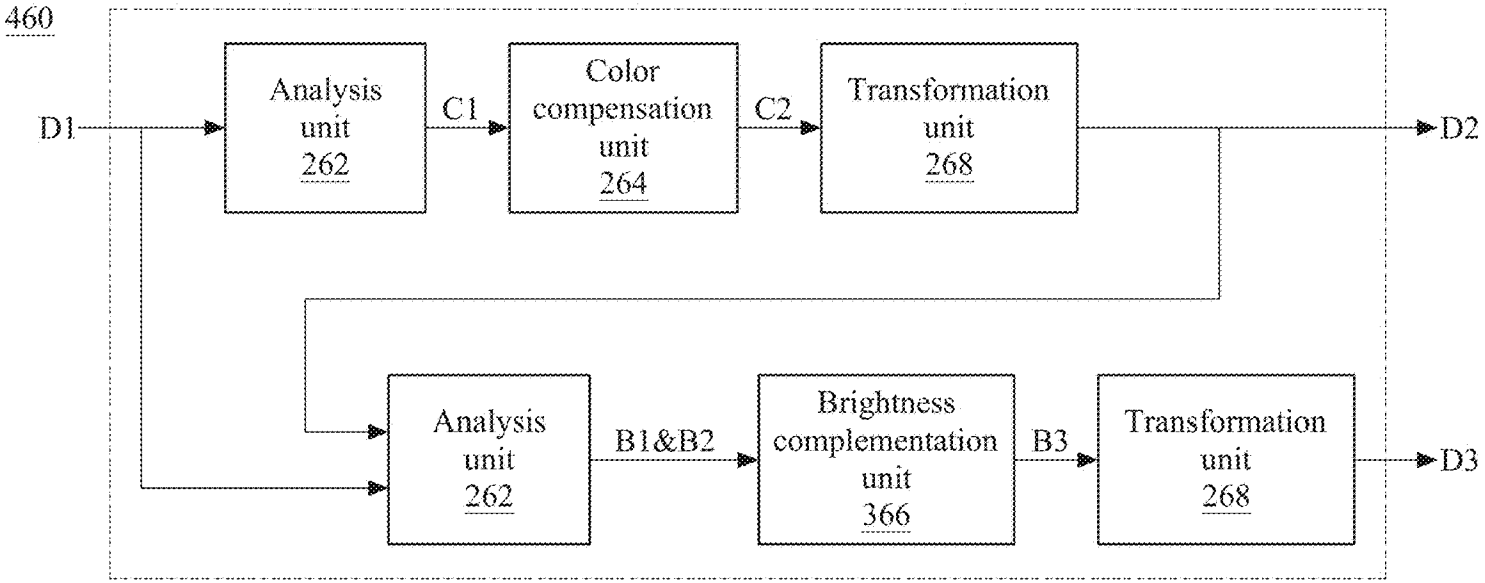
FIG. 6C is a schematic functional block diagram of a modulator in the display apparatus according to another embodiment of the disclosure.

Please refer to FIG. 6C, which is a schematic functional block diagram of a modulator in the display apparatus according to another embodiment of the disclosure. At the narrow viewing angle display mode, the display panel 210 receives and displays the data signal D1 and the data signal D2. The data signal D2 is defined according to the data signal D1. The analysis unit 262 analyzes the content of the data signal D1 and obtains a chromaticity value C1. The color compensation unit 264 generates a complementary chromaticity value C2 according to the chromaticity value C1. The chromaticity values C1 and C2 are complementary values and symmetrical to each other about the center of the same color space. The transformation unit 268 generates a data signal D2 according to the chromaticity value C2.

Then, the analysis unit 262 analyzes the brightness contents of the data signals D1 and D2 and obtains a brightness value B1 and a brightness value B2, respectively. A brightness complementation unit 366 generates a brightness value B3 according to the brightness value B1 and the brightness value B2. The brightness value B3 is complementary to a sum of the brightness value B1 and the brightness value B2 and is symmetrical to the sum of the brightness values B1 and B2 about the origin of the brightness axis. The brightness value B3 is transformed into a data signal D3.

In another embodiment, the brightness complementation operation is performed before the color complementation operation is performed. The disclosure has no limit on the priorities of these operations.

The complementation of chromaticity and brightness in the foregoing embodiments prevents viewers from sensing the chromaticity and brightness of an image frame at a main viewing angle at the narrow viewing angle display mode and may better peep-proof effect as compared to the modulator 260 compensating either chromaticity or brightness.

Embodiments of a peep-proof display method, applied to the above the peep-proof display apparatus, are illustrated below.

First Embodiment

Figure 7A:
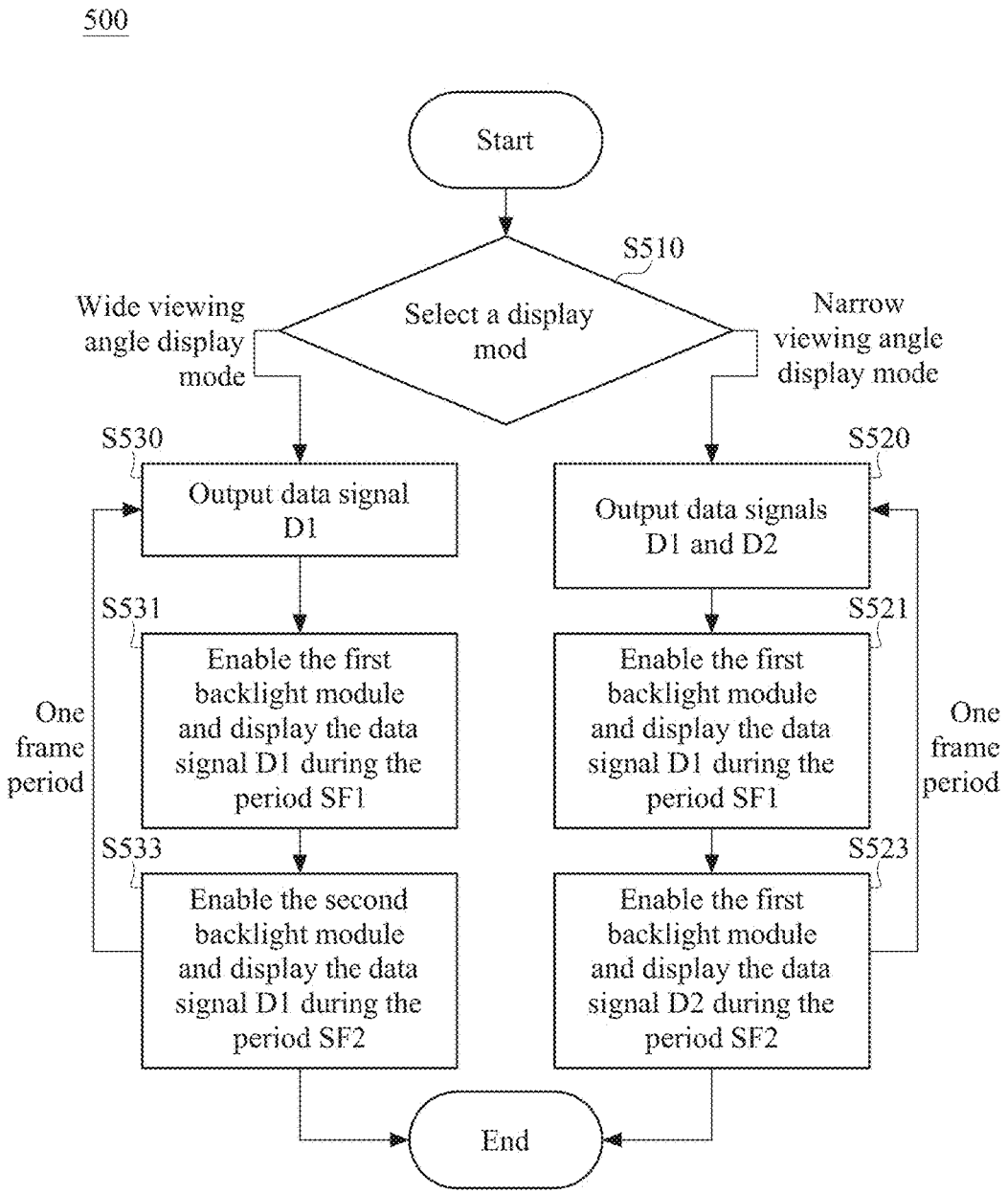
FIG. 7A is a flow chart of a display method according to a first embodiment of the disclosure.

FIG. 7A is a flow chart of a display method 500 according to a first embodiment of the disclosure. The display method 500 includes steps of:

S510: switching to either the wide viewing angle display mode or the narrow viewing angle display mode;

S520: outputting the data signal D1 and outputting the data signal D2 different from the data signal D1 according to the data signal D1 at the narrow viewing angle display mode;

S521: enabling the first backlight module, disabling the second backlight module, and displaying the data signal D1 on the display panel during the sub-frame period SF1; and S523: enabling the second backlight module, disabling the first backlight module, and displaying the data signal D2 on the display panel during the sub-frame period SF2 not overlapping the sub-frame period SF1;

S530: outputting the data signal D1 at the wide viewing angle display mode;

S531: enabling the first backlight module and displaying the data signal D1 on the display panel during the sub-frame period SF1; and S533: enabling the second backlight module and displaying the data signal D1 on the display panel during the sub-frame period SF2.

Figure 7B:
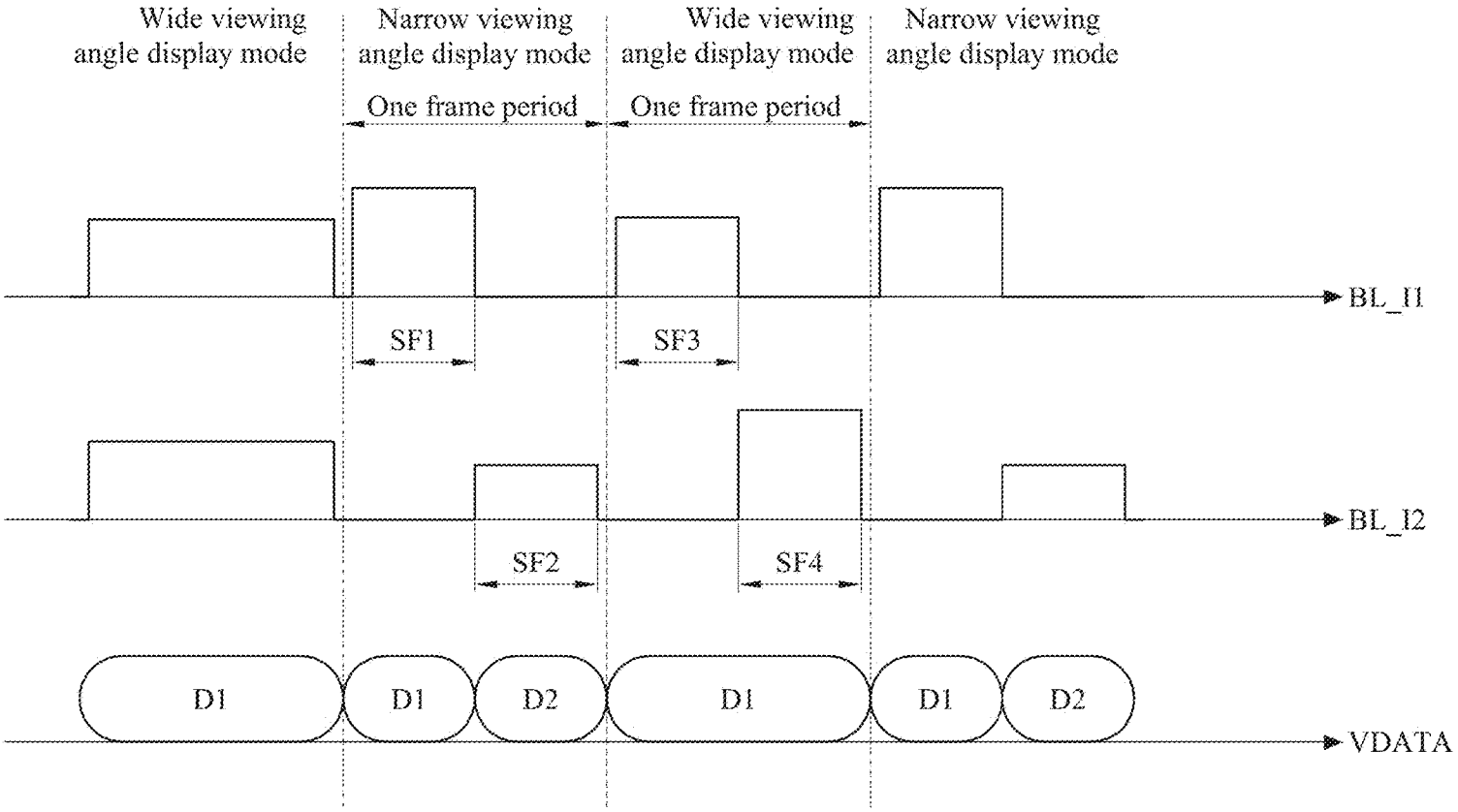
FIG. 7B is a schematic waveform diagram of signals when the display method in the first embodiment is performed.

Please refer to FIG. 7B, which is a schematic waveform diagram of signals when the display method 500 in FIG. 7A is performed. When the display panel 210 operates at the narrow viewing angle display mode, the data signal D1 is outputted and the data signal D2 is outputted according to the data signal D1 in step S520. The data signal D2 is different from the data signal D1. The modulator 260 generates the data signal D2 according to the data signal D1, and the production of the data signal D2 can be referred to the above description and thus, will not be repeated hereinafter. During the sub-frame period SF1, the backlight module 252 is enabled, the backlight module 254 is disabled, and the data signal D1 is displayed on the display panel 210 in step S521. Therefore, the display apparatus 200 emits light toward the narrow viewing angle range. During the sub-frame period SF2, the backlight module 254 is enabled, the backlight module 252 is disabled, and the data signal D2 is displayed on the display panel 210 in step S523. Herein, the display apparatus 200 employs the backlight module 254 to emit light toward the wide viewing angle range in order to compensate a leakage of the image frame that corresponds to the data signal D1 and is leaked to the wide viewing angle range. The sub-frame period SF1 does not overlap the sub-frame period SF2. In this or some embodiment, step S521 and step S523 can, as unlimited, exchange their priorities.

So-called sub-frame period is one sub interval in a frame period. The frame rate of a general display apparatus is usually 60, 120 or 180 hertz (Hz), and the disclosure will not be limited thereto. In general, an image frame combines a number of sub-image frames together in order to protect a viewer from sensing flickers so a frequency for sub-image frames is 120 Hz. When one frame period has two sub-frame periods, this frame period corresponds to a 60 Hz frequency. Even if there is some light leaking to the wide viewing angle range, viewers can not see a correct image frame in the wide viewing angle range because of a combination of different sub-image frames having complementary chromaticity values and brightness values, so as to achieve good peep-proof effect.

As shown in FIG. 7B, at the wide viewing angle display mode, a driving current BL_I1 for the backlight module 252 is substantially equal to or smaller than a driving current BL_I2 for the backlight module 254. Then, the brightness value provided by the backlight module 254 for the wide viewing angle range is substantially equal to the brightness value provided by the backlight module 252 for the narrow viewing angle range, thereby achieving good wide viewing angle display effect.

Alternately, at the narrow viewing angle display mode, the driving current BL_I1 for the backlight module 252 is higher than the driving current BL_I2 for the backlight module 254. Then, the brightness value provided by the backlight module 254 for the wide viewing angle range is lower than the brightness value provided by the backlight module 252 for the narrow viewing angle range; meanwhile, the brightness value corresponding to the driving current BL_I2 in the wide viewing angle range is substantially equal to the brightness value corresponding to the driving current BL_I1 in the wide viewing angle range. This may cause image interferences and achieve good narrow viewing angle display effect.

The display method 500 further includes switching to either the wide viewing angle display mode or the narrow viewing angle display mode in step S510. Specifically, the time controller 230 in step S510 outputs a selection signal to command the display panel 210 to operate at either the wide viewing angle display mode or the narrow viewing angle display mode. The selection of operation modes is carried out by the manual input from an interface in an example or is automatic in another example.

The display method 500 at the wide viewing angle display mode further includes step S530, where the data signal D1 is output, step S531, where the backlight module 252 is enabled and the data signal D1 is displayed on the display panel 210 during the sub-frame period SF1, and step S533, where the second backlight module 254 is enabled and the data signal D1 is displayed on the display panel 210 during the sub-frame period SF2. When these backlight modules are alternately enabled to display the data signal D1, the viewing angle range can become wider, thereby achieving good wide viewing angle display. In some embodiments, step S531 and step S533 can exchange their priorities or be performed at the same time.

In an embodiment, the data signal D1 has a chromaticity value C1, the data signal D2 has a chromaticity value C2, and the chromaticity value C1 is complementary to the chromaticity value C2. The complementation of chromaticity may compensate the light leaking toward the wide viewing angle range.

In another embodiment, the data signal D1 has a brightness value B1, the data signal D2 has a brightness value B2, and the brightness value B1 is complementary to the brightness value B2. The complementation of brightness may neutralize the image content leaking toward the wide viewing angle range. That is, the complementation of brightness may normalize the brightness of the light leakage in the wide viewing angle range.

In another embodiment, the data signal D1 has a chromaticity value C1 and a brightness value B1, the data signal D2 has a chromaticity value C2 and a brightness value B2, the chromaticity value C1 is complementary to the chromaticity value C2, and the brightness value B1 is complementary to the brightness value B2. The complementation of chromaticity and brightness may compensate the light leaking toward the wide viewing angle range.

In another embodiment, the data signal D1 has a gamma curve G1, the data signal D2 has a gamma curve G2, and the gamma curve G2 is an inverse of the gamma curve G1. The complementation of gamma curves compensates the light leaking toward the wide viewing angle range. The inverse of the gamma curve G1 may include a gamma curve G2' and/or a gamma curve G2" based on a different symmetrical axis.

Figure 8A:
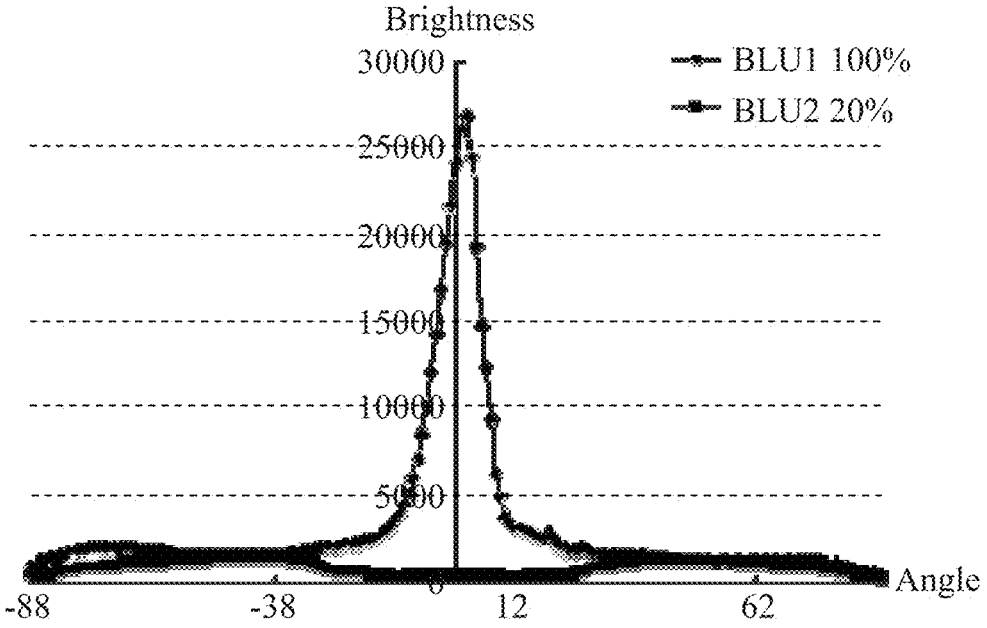
FIG. 8A is a schematic light distribution diagram at a narrow viewing angle display mode when the display method in the first embodiment is performed.

FIG. 8A is a schematic light distribution diagram at a narrow viewing angle display mode when the display method 500 in the first embodiment is performed. The backlight module 252 has a light distribution curve BLU1, and the backlight module 254 has a light distribution curve BLU2. At the narrow viewing angle display mode, the light, conveying the image frame, mainly propagates from the backlight module 252 with a light distribution of a narrow viewing angle such that the backlight module 252 may provide a 80-100% light intensity. However, the light intensity provided by the backlight module 252 is unnecessarily between 80% and 100%, and the environment around the display apparatus and the power value for the backlight module 252 also affect the light intensity provided by the backlight module 252.

In practice, the light intensity provided by the backlight module 252 is stronger than the light intensity provided by the backlight module 254. Since the backlight module 254 is used to compensate the light leakage in the wide viewing angle, the light intensity provided by the backlight module 254 is 1-20%. Also, the light intensity provided by the backlight module 254 is designed based on the light intensity provided by the backlight module 252. In an example, as shown in FIG. 8A, the backlight module 254 provides a 20% light intensity while the backlight module 252 provides a 100% light intensity. Herein, the image content corresponding to the data signal D1 and appearing in the wide viewing angle range is offset or interfered by the image content corresponding to the complementary data signal D2 and appearing in the wide viewing angle range.

Figure 8B:
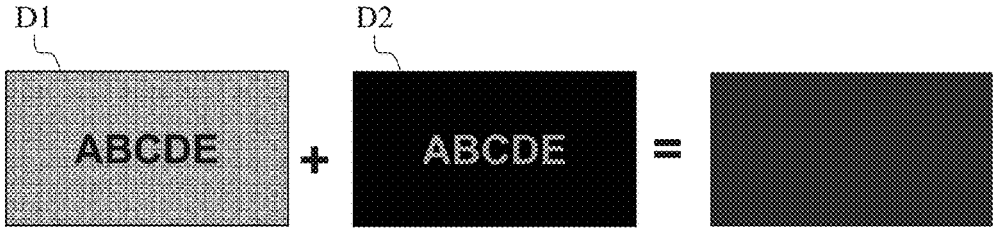
FIG. 8B is a schematic diagram of an image at the narrow viewing angle display mode when the display method in the first embodiment is performed.

Please refer to both FIG. 8A and FIG. 8B, which is a schematic diagram of an image at the narrow viewing angle display mode when the display method 500 in the first embodiment is performed. The backlight module 252 may leak a minority of light to the wide viewing angle range as shown in FIG. 8A so the display apparatus 200 can enable the backlight module 254 and display the image frame corresponding to the data signal D2, so as to offset the leakage of light corresponding to the data signal D1 in the wide viewing angle range. Also, the light intensity provided by the backlight module 254 is decided based on the light intensity provided by the backlight module 252. For example, the data signal D2 and the data signal D1 have the same saturation and brightness and complementary hues or have the same hue and complementary brightness. As shown in FIG. 8B, the data signal D2 and the data signal D1 have the same hue and saturation and different brightness such that the peep-proof image frame provided by both the data signal D2 and the data signal D1 falls on the origin of the brightness axis (e.g. the point redisplaying a gray value of 128) and then has better peep-proof effect.

Figure 9A:
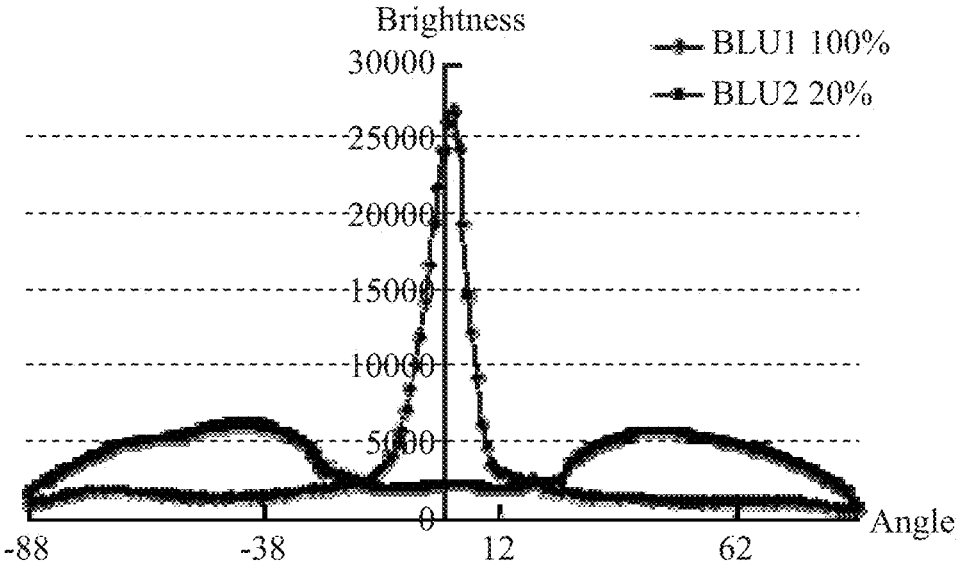
FIG. 9A is a schematic light distribution diagram of a NG image at the narrow viewing angle display mode when the display method in the first embodiment is performed.
Figure 9B:
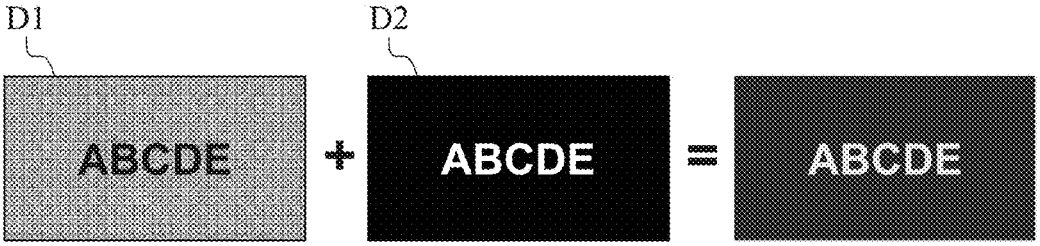
FIG. 9B is a schematic light distribution diagram of a NG image when the display method in the first embodiment is performed.

Please refer to FIGS. 9A and 9B, which are respectively a schematic light distribution diagram and a schematic diagram of a NG image at the narrow viewing angle display mode when the display method 500 in the first embodiment is performed. The backlight module 252 has a light distribution curve BLU1, and the backlight module 254 has a light distribution curve BLU2. At the narrow viewing angle display mode, the backlight module 252 and the backlight module 254 provide the same light intensity, and the light intensity corresponding to the data signal D2 is stronger than the light intensity corresponding to the data signal D1 in the wide viewing angle range. Therefore, side viewers still can see a combination of the image contents corresponding to the data signals D1 and D2, and it means that the display apparatus herein has not good peep-proof effect.

Figure 10:
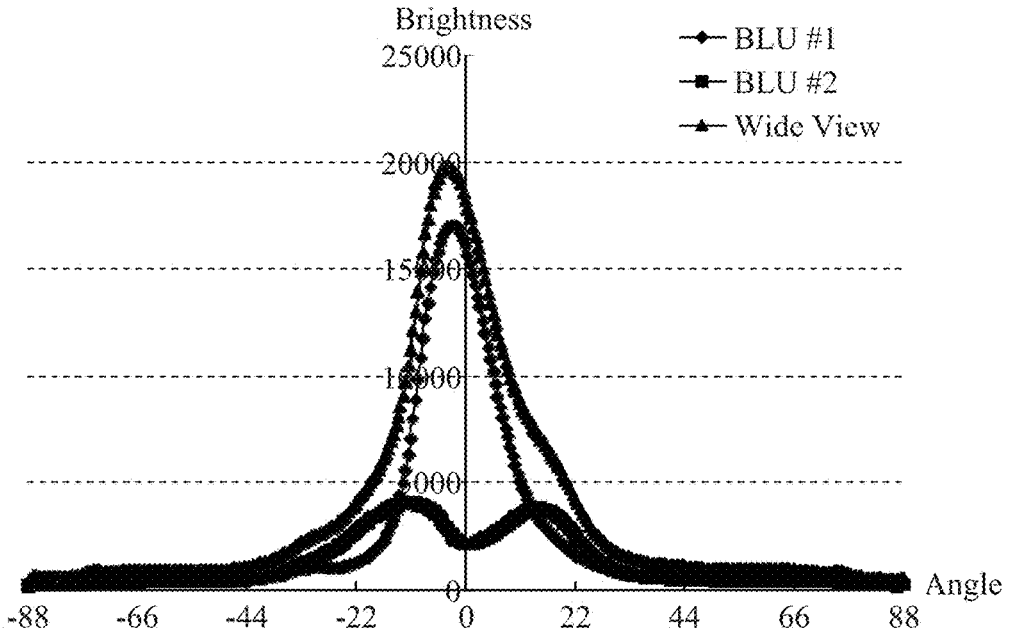
FIG. 10 is a schematic light distribution diagram at a wide viewing angle display mode when the display method in an embodiment is performed.

FIG. 10 is a schematic light distribution diagram at a wide viewing angle display mode when the display method in an embodiment is performed. The backlight module 252 has a light distribution curve BLU1, and the backlight module 254 has a light distribution curve BLU2. The backlight module 252 and the backlight module 254 provide the same light intensity so that the backlight module 250 including the backlight modules 252 and 254 at the wide viewing angle display mode has a light distribution curve that corresponds to a wider viewing angle range, as compared to a backlight module only having the light distribution curve BLU1. In other words, side viewers may be able to sense light when staying at a wider viewing angle.

Second Embodiment

Figure 11A:
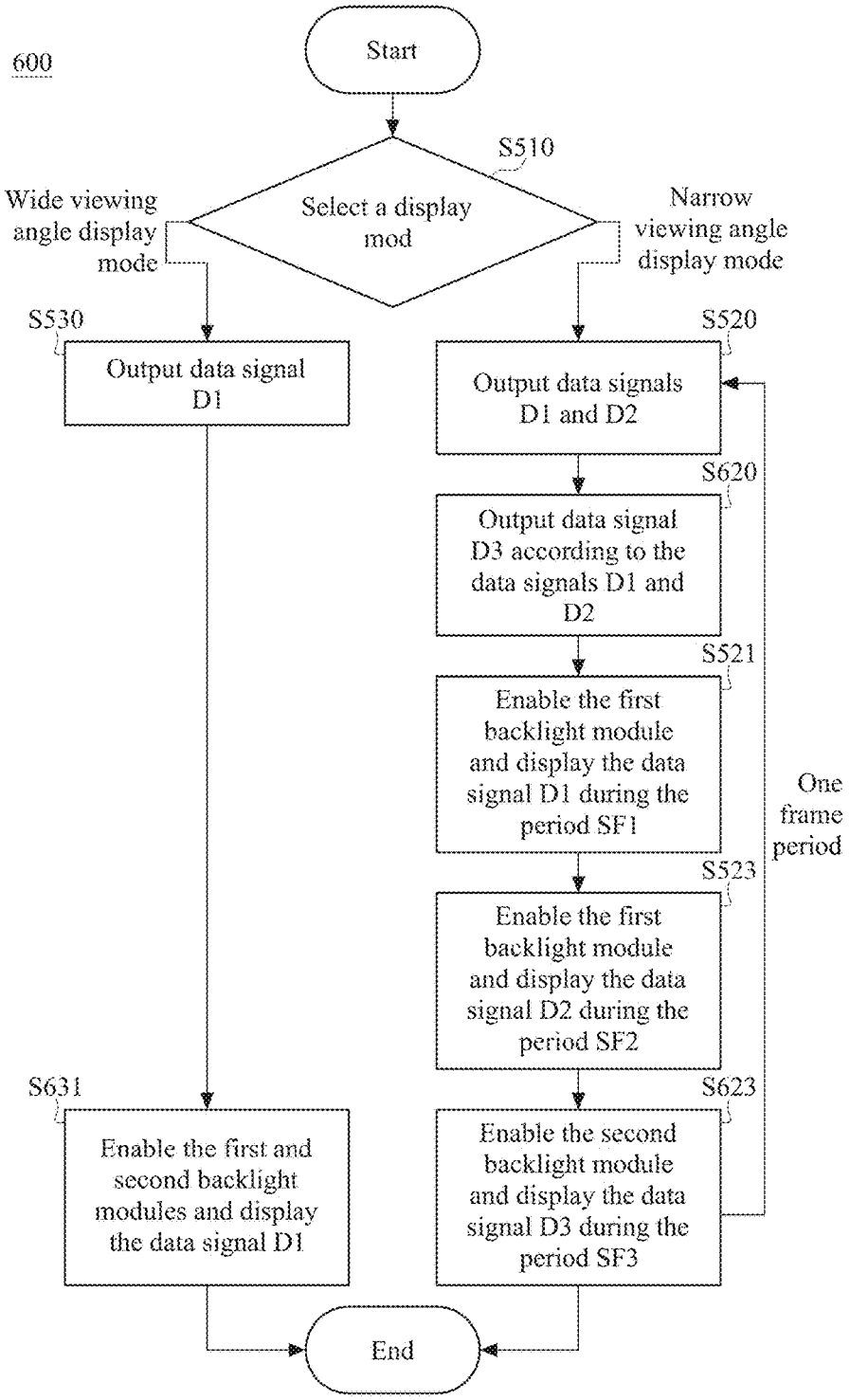
FIG. 11A is a flow chart of a display method according to a second embodiment.

FIG. 11A is a flow chart of a display method 600 according to a second embodiment. The display method 600 includes steps of:

S510: switching to either the wide viewing angle display mode or the narrow viewing angle display mode;

S520: outputting the data signal D1 and outputting the data signal D2, which is different from the data signal D1, according to the data signal D1 at the narrow viewing angle display mode;

S620: outputting the data signal D3 according to the data signal D1 and the data signal D2, wherein when the chromaticity value C2 is complementary to the chromaticity value C1, a combination (or sum) of the brightness value B1 and the brightness value B2 is complementary to the brightness value B3, or when the brightness value B2 is complementary to the brightness value B1, a combination of the chromaticity value C1 and the chromaticity value C2 is complementary to the chromaticity value C3;

S521: enabling the first backlight module, disabling the second backlight module, and displaying the data signal D1 on the display panel during the sub-frame period SF1;

S523: enabling the second backlight module, disabling the first backlight module, and displaying the data signal D2 on the display panel during the sub-frame period SF2;

S623: enabling the second backlight module, disabling the first backlight module, and displaying the data signal D3 on the display panel during the sub-image frame SF3, the sub-frame periods SF1, SF2 and SF3 not overlapping each other;

S530: outputting the data signal D1 at the wide viewing angle display mode; and

S631: enabling the first backlight module and the second backlight module simultaneously and displaying the first data signal D1 on the display panel.

Figure 11B:
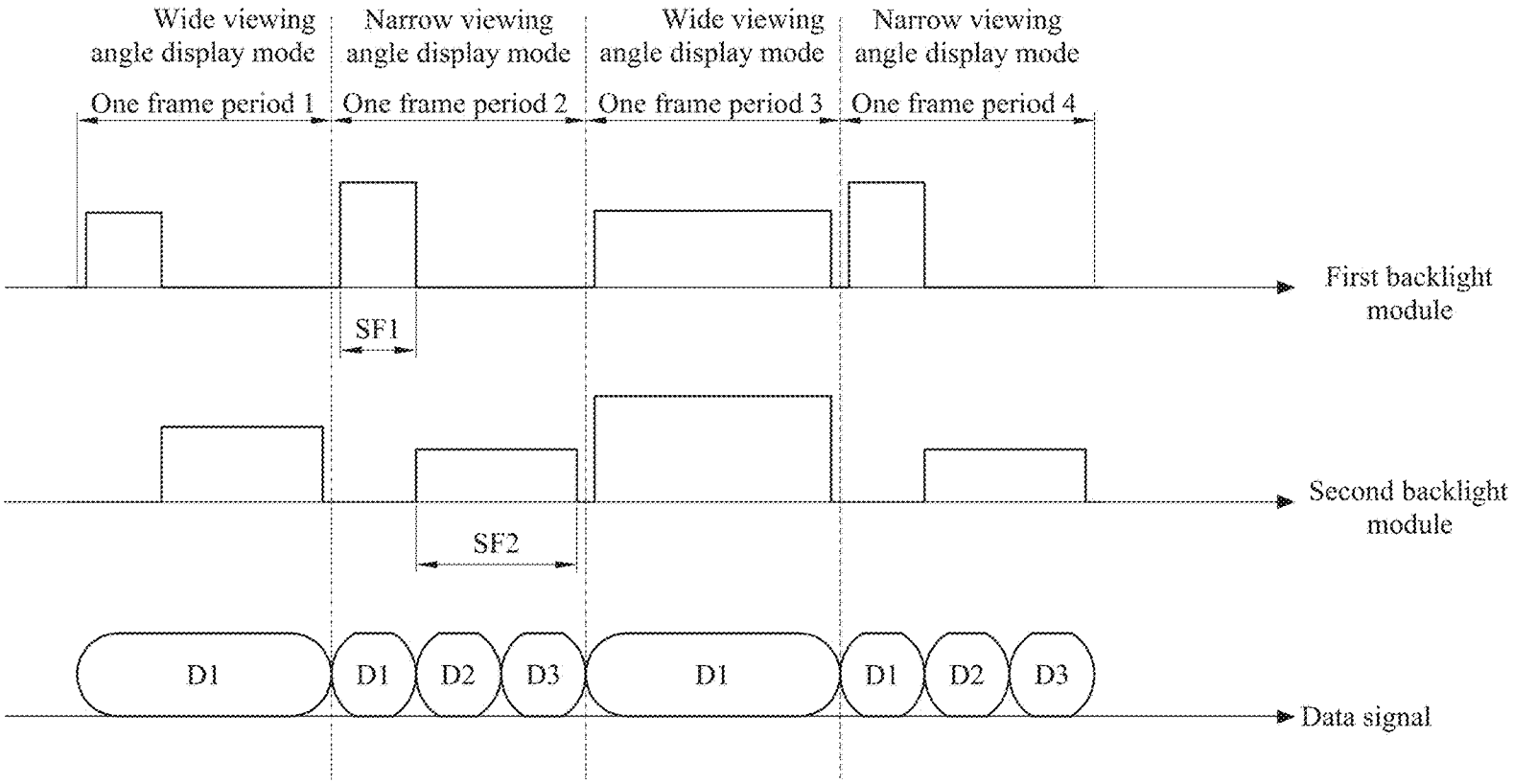
FIG. 11B is a schematic waveform diagram of signals when the display method in the second embodiment is performed.

Please refer to FIG. 11A and FIG. 11B, which is a schematic waveform diagram of signals when the display method 600 in the second embodiment is performed. The display method 600 is substantially similar to the display method 500, and the same portion therebetween will not be repeated hereinafter. Notice that the display method 600 further comprises step S620 and step S623 at the narrow viewing angle display mode.

In step S620, the data signal D3 is output according to the data signals D1 and D2. When the chromaticity value C2 is complementary to the chromaticity value C1, the sum of the brightness value B1 and the brightness value B2 is complementary to the brightness value B3. Alternatively, when the brightness value B2 is complementary to the brightness value B1, the sum of the chromaticity value C1 and the chromaticity value C2 is complementary to the chromaticity value C3. Because a color space is a nonlinear space and is related to a plurality of parameters, such as chromaticity (hue), saturation and brightness, the display apparatus only compensating a single parameter may not achieve optimal peep-proof effect.

Figure 14A:
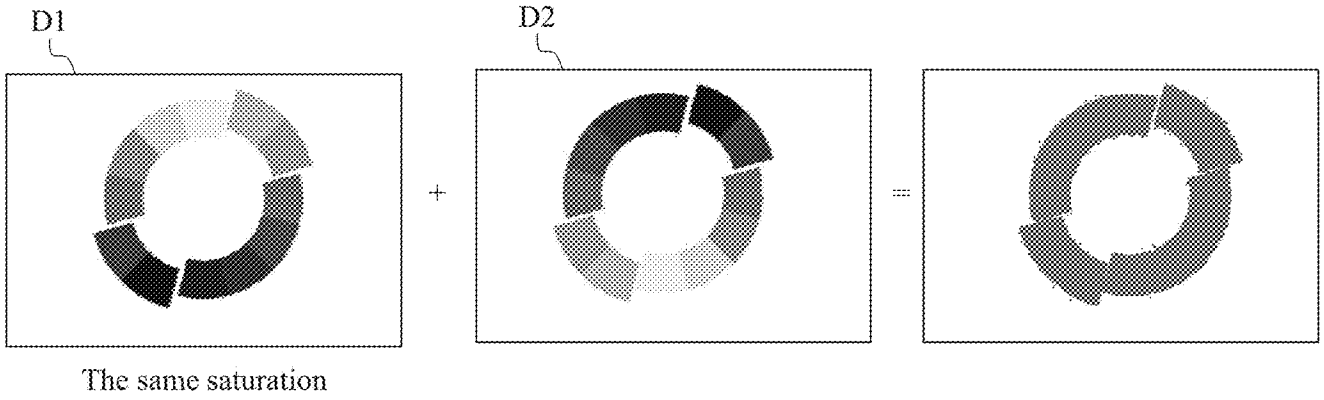
FIG. 14A is a schematic diagram of images specified by data signals with the same brightness value at the narrow viewing angle display mode when the display method in an embodiment is performed.
Figure 14B:
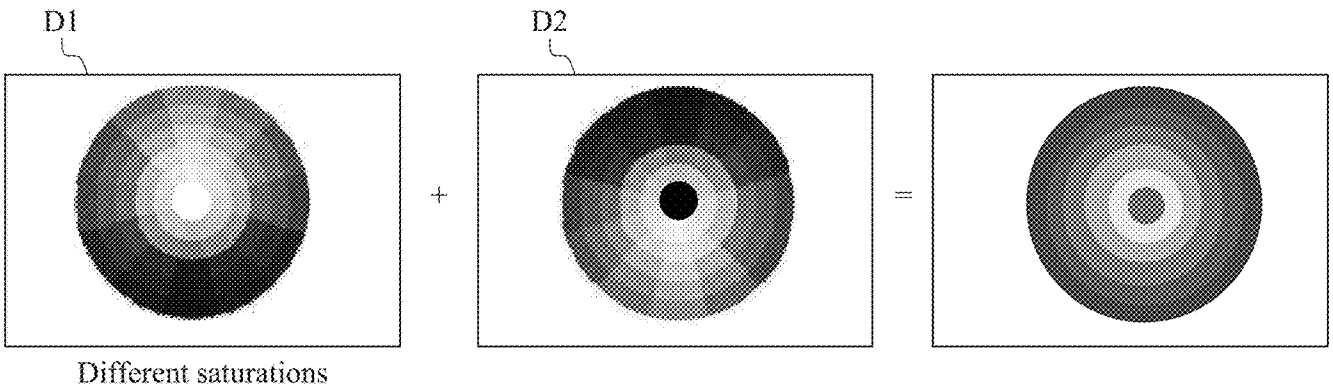
FIG. 14B is a schematic diagram of images specified by data signals with different brightness values at the narrow viewing angle display mode when the display method in an embodiment is performed.

Please refer to FIGS. 14A and 14B, which shows a schematic diagram of images specified by data signals with the same brightness value and a schematic diagram of images specified by data signals with different brightness values at the narrow viewing angle display mode, respectively. The data signal D1 having the same chromatic circle has the same saturation and different chromaticities (hues), as shown in FIG. 14A. Herein, the data signal D2 having a complementary color value is used to compensate the image of the data signal D1 in order to achieve good peep-proof effect.

Alternatively, when the data signal D1 has a plurality of chromatic circles, it means that the data signal D1 has different chromaticity values and saturation values, as shown in FIG. 14B. When only the data signal D2 having a complementary color value is used to compensate chromaticity, a combination of images may have the same chromaticity and different saturations. Herein, the data signal D3 is further used to compensate saturation, so as to achieve good peep-proof effect.

In step S623, during the sub-image frame SF3, the backlight module 254 is enabled, the backlight module 252 is disabled, and the data signal D3 is displayed on the display panel 210. The display apparatus 200 employs the light, provided by the backlight module 254 and propagating to the wide viewing angle range, to compensate a part of the mixed light corresponding to both the data signal D1 and the data signal D2 and leaking to the wide viewing angle range. The sub-frame period SF1, the sub-frame period SF2 and the sub-image frame SF3 do not overlap each other. The second embodiment simultaneously compensating such two parameters may have better compensation effect, as compared to the first embodiment compensating only one parameter.

In another embodiment, the data signal D1 has a gamma curve G1, the data signal D2 has a gamma curve G2, and the gamma curve G2 is an inverse of the gamma curve G1. The complementation of gamma curves may compensate the light leaking to the wide viewing angle range. The data signal D3 has a gamma curve G3, and the gamma curve G3 is related to the gamma curve G1 and the gamma curve G2. In an example, the gamma curve G3 is an inverse of a combination of the gamma curves G1 and G2. The priorities can be changed.

At the wide viewing angle display mode, the display method 600 further includes step S631, in which the first backlight module 252 and the second backlight module 254 are simultaneously enabled and the first data signal is displayed on the display panel 210. As compared to step S531 to step S533, simultaneously enabling the first backlight module 252 and the second backlight module 254 may prevent viewers from sensing flickers during the alternatively-switching on of the backlight modules.

Step S620 has a higher priority than step S521 in an embodiment. In another embodiment, step S620 has a lower priority than step S523, and step S620 and step S623 are performed after the time controller 230 or a processor confirms if the data signal D2 has compensated the data signal D1. These priorities will not limit the scope of the disclosure.

Third Embodiment

Figure 12A:
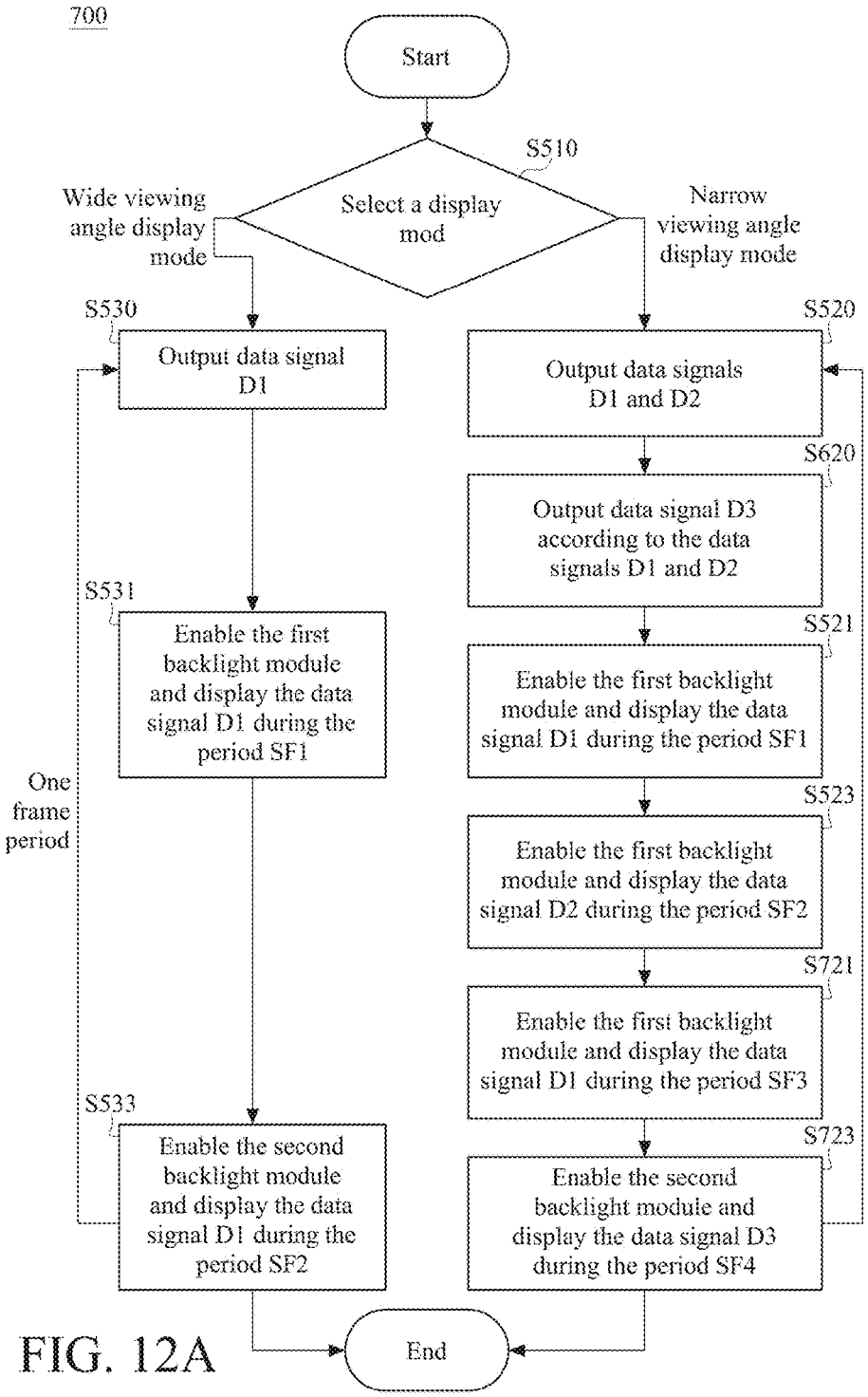
FIG. 12A is a flow chart of a display method according to a third embodiment.

FIG. 12A is a flow chart of a display method 700 according to a third embodiment. The display method 700 includes steps of:

S510: switching to either the wide viewing angle display mode or the narrow viewing angle display mode;

S520: outputting the data signal D1 and outputting the data signal D2 according to the data signal D1 at the narrow viewing angle display mode, and the data signal D2 being different from the data signal D1;

S620: outputting the data signal D3 according to the data signals D1 and D2, wherein when the chromaticity value C2 is complementary to the chromaticity value C1, a sum of the brightness values B1 and B2 is complementary to the brightness value B3, or when the brightness value B2 is complementary to the brightness value B1, a sum of the chromaticity values C1 and C2 is complementary to the chromaticity value C3;

S521: enabling the first backlight module and disabling the second backlight module to display the data signal D1 on the display panel during the sub-frame period SF1; and S523: enabling the second backlight module and disabling the first backlight module to display the data signal D2 on the display panel during the sub-frame period SF2;

S721: enabling the first backlight module and disabling the second backlight module to display the data signal D1 on the display panel during the sub-image frame SF3; and S723: enabling the second backlight module and disabling the first backlight module to display the data signal D3 on the display panel during the sub-image frame SF4, wherein these sub-frame period do not overlap;

S530: outputting the data signal D1 at the wide viewing angle display mode; and

S531: enabling the first backlight module to display the data signal D1 on the display panel during the sub-frame period SF1.

Figure 12B:
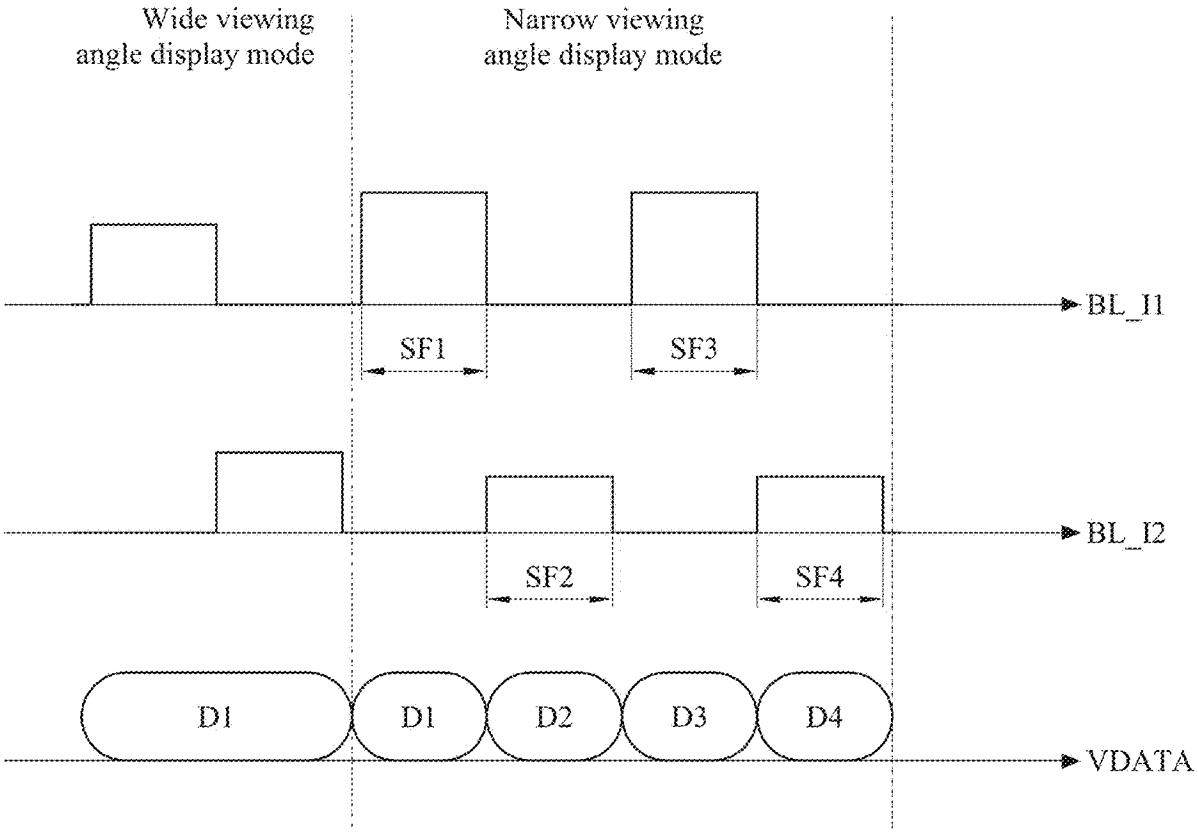
FIG. 12B is a schematic waveform diagram of signals when the display method in the third embodiment is performed.

Please refer to FIG. 12A and FIG. 12B, which is a schematic waveform diagram of signals when the display method 700 in the third embodiment is performed. The display method 700 is substantially same as the display method 600, and the same part will not be repeated hereinafter. At the narrow viewing angle display mode, the display method 700 further comprises step S721 and step S723. In step S721, during the sub-image frame SF3, the backlight module 252 is enabled while the backlight module 254 is disabled, and the data signal D1 is displayed on the display panel 210. In step S723, during the sub-image frame SF4, the backlight module 254 is enabled while the backlight module 252 is disabled, and the data signal D3 is displayed on the display panel 210.

In the display method 600, one frame period is divided into a plurality of sub-image frames. Then, the data signal D1 is displayed during the sub-frame period SF1, and the data signals D2 and D3 are displayed during the sub-frame periods SF2 and SF3, respectively, for light compensation. However, underclocking, which means to set a lower timing, also known as downclocking, may cause that viewers sense flickers on the screen. Herein, uses each frame period used in the display method 700 includes the sub-frame periods SF1 to SF4 in an example or includes either the sub-frame periods SF1 and SF2 or the sub-image frames SF3 and SF4 in another example according to user's setting or the setting of the time controller in order to prevent viewers from sensing flickers or other defects.

In step S521, during the sub-frame period SF1, the backlight module 252 is enabled while the backlight module 254 is disabled, and the data signal D1 is displayed on the display panel 210. Herein, the display apparatus 200 mainly provides light toward the narrow viewing angle range.

In step S523, during the sub-frame period SF2, the backlight module 254 is enabled while the backlight module 252 is disabled, and the data signal D2 is displayed on the display panel 210. The display apparatus 200 herein employs the backlight module 254 to provide light toward the wide viewing angle range.

In step S721, during the sub-image frame SF3, the backlight module 252 is enabled while the backlight module 254 is disabled, and the data signal D1 is displayed on the display panel 210. The display apparatus 200 herein mainly provides light to the narrow viewing angle range.

In step S723, during the sub-image frame SF4, the backlight module 254 is enabled while the backlight module 252 is disabled, and the data signal D3 is displayed on the display panel 210. The display apparatus 200 herein employs the backlight module 254 to provide light toward the wide viewing angle range.

As compared to the display method 600, the display method 700 can provide more time for the display of the data signal D1 through the alternate compensation provided by the data signals D2 and D3, so viewers may not sense flickers on the screen.

As set forth above, the disclosure provides a peep-proof display method to compensate a data signal (i.e. the data signal D1) by the complementation of one or more color parameters, such as chromaticity, saturation and brightness in order to achieve good peep-proof effect. At the narrow viewing angle display mode, a complementary signal complementary to the data signal is outputted, and a different backlight module having a different light distribution is also used to assists in displaying images during a different sub-frame period in order to achieve good peep-proof effect.

The disclosure also provides a peep-proof display apparatus including multiple backlight modules having different light distributions, and the time controller. The time controller outputs a complementary signal complementary to the data signal D1 according to the data signal D1. Also, the alternate operation of these backlight modules assists in displaying display images, thereby compensating the chromaticity, saturation and/or brightness of the image conveys by a light leakage in the wide viewing angle range in order to achieve good peep-proof effect at a narrow viewing angle.

What is claimed is:

1. A peep-proof display method, which is applied to a display apparatus comprising a display panel, a first backlight module and a second backlight module, the method comprising:

outputting a first data signal and a second data signal at a narrow viewing angle display mode, the first data signal having a first chromaticity value and a first brightness value, and the second data signal having a second chromaticity value and a second brightness value, and wherein the second data signal is generated based on the first data signal by a modulator;

enabling the first backlight module and disabling the second backlight module, wherein, while the first backlight module is enabled, controlling the first backlight module with the first data signal to emit light configured to display a first image on the display panel during a first sub-frame period; and enabling the second backlight module and disabling the first backlight module, wherein, while the second backlight module is enabled, controlling the second backlight module with the second data signal to emit light configured to display a second image on the display panel during a second sub-frame period, wherein the first backlight module has a first light intensity distribution curve only having a peak in a narrow viewing angle range, the second backlight module has a second light intensity distribution curve only having peaks in a wide viewing angle range, the wide viewing angle range does not overlap the narrow viewing angle range, and the first sub-frame period does not overlap the second sub-frame period.

2. The peep-proof display method according to claim 1, further comprising:

outputting the first data signal at a wide viewing angle display mode; and enabling the first backlight module and the second backlight module to display the first data signal on the display panel.

3. The peep-proof display method according to claim 2, wherein enabling the first backlight module and the second backlight module to display the first data signal on the display panel comprises:

enabling the first backlight module and disabling the second backlight module during a third sub-frame period; and enabling the second backlight module and disabling the first backlight module during a fourth sub-frame period.

4. The peep-proof display method according to claim 2, wherein when the first data signal is outputted at the wide viewing angle display mode, a light intensity of mixed light provided by the first backlight module and the second backlight module in the narrow viewing angle range is stronger than a light intensity of the mixed light in the wide viewing angle range.

5. The peep-proof display method according to claim 2, further comprising:

switching to either the wide viewing angle display mode or the narrow viewing angle display mode.

6. The peep-proof display method according to claim 1, wherein when the first data signal is outputted and the second data signal is outputted according to the first data signal at the narrow viewing angle display mode, the second chromaticity value is a complementary color value of the first chromaticity value.

7. The peep-proof display method according to claim 1, wherein when the first data signal is outputted and the second data signal is outputted according to the first data signal at the narrow viewing angle display mode, the second brightness value is complementary to the first brightness value.

8. The peep-proof display method according to claim 1, wherein during the narrow viewing angle display mode where the first data signal is outputted and the second data signal is outputted according to the first data signal, the peep-proof display method further comprises:

outputting a third data signal according to the first data signal and the second data signal, wherein the third data signal has a third chromaticity value and a third brightness value; and when the second chromaticity value is complementary to the first chromaticity value, a sum of the first brightness value and the second brightness value is complementary to the third brightness value; or when the second brightness value is complementary to the first brightness value, a sum of the first chromaticity value and the second chromaticity value is complementary to the third chromaticity value.

9. The peep-proof display method according to claim 8, further comprising:

enabling the second backlight module and disabling the first backlight module to display the third data signal on the display panel during a third sub-frame period.

10. The peep-proof display method according to claim 8, further comprising:

enabling the first backlight module and disabling the second backlight module to display the first data signal on the display panel during a third sub-frame period; and enabling the second backlight module and disabling the first backlight module to display the third data signal on the display panel during a fourth sub-frame period.

11. The peep-proof display method according to claim 1, wherein when the first data signal is outputted and the second data signal is outputted according to the first data signal at the narrow viewing angle display mode, a light intensity of mixed light provided by the first and second backlight modules in the narrow viewing angle range is substantially equal to a light intensity of the mixed light in the wide viewing angle range.

12. The peep-proof display method according to claim 1, wherein the first data signal is outputted from a time controller to a data driver.

13. A peep-proof display method, which is applied to a display apparatus comprising a display panel, a first backlight module and a second backlight module, the method comprising:

outputting a first data signal and a second data signal at a narrow viewing angle display mode, the first data signal having a first gamma curve, the second data signal having a second gamma curve symmetrical to the first gamma curve, and wherein the second data signal is generated based on the first data signal by a modulator;

enabling the first backlight module and disabling the second backlight module, wherein, while the first backlight module is enabled, controlling the first backlight module with the first data signal to emit light configured to display a first image on the display panel during a first sub-frame period; and enabling the second backlight module and disabling the first backlight module, wherein, while the second backlight module is enabled, controlling the second backlight module with the second data signal to emit light configured to display a second image on the display panel during a second sub-frame period, wherein the first backlight module has a first light intensity distribution curve only having a peak in a narrow viewing angle range, the second backlight module has a second light intensity distribution curve only having peaks in a wide viewing angle range, the wide viewing angle range does not overlap the narrow viewing angle range, and the first sub-frame period does not overlap the second sub-frame period.

14. The peep-proof display method according to claim 13, further comprising:

outputting the first data signal at a wide viewing angle display mode; and enabling the first backlight module and the second backlight module to display the first data signal on the display panel.

15. The peep-proof display method according to claim 14, wherein when the first data signal is outputted at the wide viewing angle display mode, a light intensity of mixed light provided by the first and second backlight modules in the narrow viewing angle range is stronger than a light intensity of the mixed light in the wide viewing angle range.

16. The peep-proof display method according to claim 13, further comprising:

switching to either the wide viewing angle display mode or the narrow viewing angle display mode.

17. The peep-proof display method according to claim 13, wherein at the narrow viewing angle display mode where the first data signal is outputted and the second data signal is outputted according to the first data signal, the peep-proof display method further comprises:

outputting a third data signal according to the first data signal and the second data signal, the third data signal having a third gamma curve that is an inverse of a combination of the first gamma curve and the second gamma curve.

18. The peep-proof display method according to claim 17, further comprising:

enabling the second backlight module and disabling the first backlight module to display the third data signal on the display panel during a third sub-frame period.

19. The peep-proof display method according to claim 17, further comprising:

enabling the first backlight module and disabling the second backlight module to display the first data signal on the display panel during a third sub-frame period; and enabling the second backlight module and disabling the first backlight module to display the third data signal on the display panel during a fourth sub-frame period.

20. The peep-proof display method according to claim 13, wherein the first data is outputted from a time controller to a data driver.

* * * * *